US011260270B1

(12) United States Patent
Owusu

(10) Patent No.: US 11,260,270 B1
(45) Date of Patent: Mar. 1, 2022

(54) INTERACTIVE PHYSICAL FITNESS SYSTEM

(71) Applicant: JAXAMO UK LIMITED, Bedfordshire (GB)

(72) Inventor: Stephen Owusu, Newcastle, WA (US)

(73) Assignee: JAXAMO UK LIMITED, Bedfordshire (GB)

( * ) Notice: Subject to any disclaimer, the term of this patent is extended or adjusted under 35 U.S.C. 154(b) by 0 days.

(21) Appl. No.: 16/998,787

(22) Filed: Aug. 20, 2020

(51) Int. Cl.

| | |
|---|---|
| ***A63B 24/00*** | (2006.01) |
| ***A63B 71/06*** | (2006.01) |
| ***A63B 21/075*** | (2006.01) |
| ***A63B 21/00*** | (2006.01) |

(52) U.S. Cl.
CPC ..... *A63B 24/0062* (2013.01); *A63B 21/075* (2013.01); *A63B 24/0087* (2013.01); *A63B 71/0622* (2013.01); *A63B 21/00069* (2013.01); *A63B 2024/0065* (2013.01); *A63B 2024/0068* (2013.01); *A63B 2071/0675* (2013.01); *A63B 2225/20* (2013.01); *A63B 2225/50* (2013.01)

(58) Field of Classification Search
CPC ..... A63B 24/0062; A63B 21/075; A63B 24/0087; A63B 71/0622; A63B 21/00069; A63B 2024/0068; A63B 2225/50; A63B 2225/20; A63B 2024/0065; A63B 2071/0675
See application file for complete search history.

(56) References Cited

U.S. PATENT DOCUMENTS

| | | | | |
|---|---|---|---|---|
| 7,578,771 | B1 * | 8/2009 | Towley, III | A63B 71/0619 482/106 |
| 7,976,443 | B2 | 7/2011 | Krull | |
| 10,099,083 | B1 | 10/2018 | Owusu | |
| 10,293,211 | B2 | 5/2019 | Watterson et al. | |
| 10,463,906 | B2 | 11/2019 | Owusu | |
| 2015/0367163 | A1 * | 12/2015 | Moran | A63B 71/0036 482/108 |
| 2016/0089559 | A1 * | 3/2016 | Smith | A63B 21/062 482/5 |

(Continued)

FOREIGN PATENT DOCUMENTS

| | | |
|---|---|---|
| CN | 201876734 U | 6/2011 |

OTHER PUBLICATIONS

U.S. Appl. No. 16/425,267, dated May 29, 2019, 56 pages.

(Continued)

*Primary Examiner* — Sundhara M Ganesan
(74) *Attorney, Agent, or Firm* — RatnerPrestia

(57) ABSTRACT

A physical fitness system includes a stand assembly including a stand, a computing device mounted on the stand, and at least one integrated docking station for receiving an exercise device. At least one exercise device is configured to be releasably mounted to the docking station. Upon receiving instructions from a user input on the computing device, the system computer processor is configured to transmit instructions over the network from a system network communication interface to an exercise device network communication interface, and upon receiving the instructions, the exercise device processor is configured to activate a driver in the exercise device to change either the resistance applied to the exercise device or the weight carried by the exercise device.

21 Claims, 18 Drawing Sheets

(56) References Cited

U.S. PATENT DOCUMENTS

| | | | | |
|---|---|---|---|---|
| 2016/0089560 | A1* | 3/2016 | Smith | A63B 21/075<br>482/108 |
| 2016/0089575 | A1* | 3/2016 | Smith | A63B 21/0726<br>482/5 |
| 2016/0184623 | A1* | 6/2016 | Moran | A63B 21/0726<br>482/8 |
| 2016/0346617 | A1* | 12/2016 | Srugo | G09B 19/0038 |
| 2017/0266503 | A1* | 9/2017 | Watterson | A63B 22/0605 |
| 2019/0240526 | A1* | 8/2019 | Owusu | A63B 21/00065 |
| 2019/0388723 | A1* | 12/2019 | Nalley | A63B 24/0087 |
| 2019/0388724 | A1* | 12/2019 | Polinsky | A63B 21/0726 |
| 2020/0172304 | A1 | 6/2020 | Owusu | |
| 2020/0289891 | A1 | 9/2020 | Owusu | |

OTHER PUBLICATIONS

U.S. Appl. No. 16/998,640, dated Aug. 20, 2020, 76 pages.
International Search Report and Written Opinion for International Application No. PCT/IB2021/000554, dated Dec. 14, 2021, 14 pages.

* cited by examiner

INTERACTIVE PHYSICAL FITNESS SYSTEM

FIELD OF THE INVENTION

The present invention relates generally to personal exercise equipment, and more particularly to an interactive fitness system comprising a stand, a computing device mounted to the stand, and multiple exercise devices that are removably connected to the stand.

BACKGROUND OF THE INVENTION

The popularity of exercising at home is on the rise, given that many people lack sufficient time to devote to a full exercise routine, much less find time to exercise at a health club, gym, or other fitness institution. There exists a need for and/or improvements to personal exercise equipment that can be used at home.

SUMMARY OF THE INVENTION

Aspects of the present invention are directed to physical fitness systems.

In accordance with an aspect of the present invention, a physical fitness system comprises:

a computing device;

a stand assembly including a stand, a display mounted to the stand, and at least one integrated docking station for receiving an exercise device; and at least one exercise device that is configured to be releasably mounted to the docking station on the stand, wherein the at least one exercise device is configured to communicate with the computing device.

In accordance with another aspect of the present invention, a physical fitness system comprises:

a stand assembly including a stand, a computing device mounted on the stand, and at least one integrated docking station for receiving an exercise device, the computing device having (i) a user input for inputting instructions to the computing device relating to the exercise device, (ii) a system network communication interface for communication over a network, and (iii) a system computer processor coupled to the user input and the system network communication interface; and at least one exercise device that is configured to be releasably mounted to the docking station, said exercise device including (i) a driver for selectively changing either a resistance applied to the exercise device or a weight carried by the exercise device, (ii) an exercise device network communication interface for communication over the network, and (iii) an exercise device processor coupled to the exercise device network communication interface and the driver; and wherein, upon receiving instructions from the user input, the system computer processor is configured to transmit instructions over the network from the system network communication interface to the exercise device network communication interface, and upon receiving the instructions, the exercise device processor is configured to activate the driver to change either the resistance applied to the exercise device or the weight carried by the exercise device.

In accordance with another aspect of the present invention, a method for operating a physical fitness system comprising (a) a stand assembly having a computing device and at least one integrated docking station for receiving an exercise device, the computing device including (i) a user input for inputting instructions to the computing device relating to the exercise device, (ii) a system network communication interface for communication over a network, and (iii) a system computer processor coupled to the user input and the system network communication interface, and (b) at least one exercise device that is configured to be releasably mounted to the docking station, said exercise device including (i) a driver for selectively changing either a resistance applied to the exercise device or weight carried by the exercise device, (ii) an exercise device network communication interface for communication over the network, and (iii) an exercise device processor coupled to the exercise device network communication interface and the driver, said method comprises:

receiving instructions via the user input of the computing device for changing either a resistance applied to the exercise device or the weight carried by the exercise device;

transmitting instructions over the network from the system network communication interface to the exercise device network communication interface; and activating the driver to change either the resistance applied to the exercise device or the weight carried by the exercise device.

In accordance with still another aspect of the present invention, a method for using a physical fitness system comprising a stand assembly having a computing device and at least one integrated docking station for receiving an exercise device, the computing device including (i) a user input for inputting instructions to the computing device relating to the exercise device, (ii) a system network communication interface for communication over a network, and (iii) a system computer processor coupled to the user input and the system network communication interface, and (b) at least one exercise device that is configured to be releasably mounted to the docking station on the stand, said exercise device including (i) a driver for selectively changing either a resistance applied to the exercise device or weight carried by the exercise device, (ii) an exercise device network communication interface for communication over the network, and (iii) an exercise device processor coupled to the exercise device network communication interface and the driver, said method comprises:

entering instructions via the user input of the computing device for changing either a resistance applied to the exercise device or the weight carried by the exercise device, which causes the instructions to be transmitted over the network from the system network communication interface to the exercise device network communication interface, which causes the driver to change either the resistance applied to the exercise device or the weight carried by the exercise device; and removing the exercise device from the stand for use.

In accordance with still another aspect of the present invention, a physical fitness system comprises:

a stand having docking stations each positioned to receive an exercise device;

exercise devices each received by and configured to be releasably mounted to a respective one of the docking stations of the stand, at least one of the exercise devices differing from another one of the other exercise devices, and at least one of the exercise devices being an adjustable exercise device including (i) a driver for selectively changing either a resistance applied to the exercise device or a weight carried by the exercise device, (ii) an exercise device network communication interface for communication over the network, and (iii) an exercise device processor coupled to the exercise device network communication interface and the driver; and a computing device mounted to the stand, the computing device having (i) a user input for inputting instructions to the computing device relating to the adjustable exercise device, (ii) a system network communication interface for communication over a network, and (iii) a system computer processor coupled to the user input and the system network communication interface; and wherein, upon receiving instructions from the user input, the system computer processor is configured to transmit instructions over the network from the system network communication interface to the exercise device network communication interface, and upon receiving the instructions, the exercise device processor is configured to activate the driver to change either the resistance applied to the exercise device or the weight carried by the exercise device;

wherein each of the exercise devices includes a sensor configured to detect use of the exercise device and a transmitter configured to transmit, to the computing device, the use detected by the sensor; and wherein the computing device is configured to receive, from each of the exercise devices, the use detected by the sensors of the exercise devices and to display a physical fitness assessment based upon the use detected by the sensors of the exercise devices.

BRIEF DESCRIPTION OF THE DRAWINGS

The invention is best understood from the following detailed description when read in connection with the accompanying drawings. When a plurality of similar elements are present, a single reference number may be assigned to the plurality of similar elements. If the same element appears on more than one drawing it will have the same reference number.

It is emphasized that, according to common practice, the various features of the drawings are not necessarily rendered to scale. On the contrary, the dimensions of the various features may be arbitrarily expanded or reduced for clarity.

Included in the drawings are the following figures:

FIG. 1A depicts a front isometric view of an interactive physical fitness system (system, hereinafter) according to one exemplary embodiment of the invention.

FIGS. 1B and 1C depict front isometric and side elevation views, respectively of the system of FIG. 1A.

FIGS. 1D and 1E depict isometric views of the system of FIG. 1A with various components removed to reveal other features of the system.

FIG. 2 depicts an isometric and partially exploded view of a push-up bar assembly of the system of FIG. 1A, shown exploded.

FIG. 3 depicts an isometric view of a kettlebell of the system of FIG. 1A, shown exploded.

FIG. 4 depicts an elevation view of a water bottle of the system of FIG. 1A.

FIG. 5 depicts an isometric view of a foam pad roller of the system of FIG. 1A, shown exploded.

FIG. 6A depicts an isometric view of a dumbbell v comprising one of the dumbbells of the system of FIG. 1A.

FIG. 6B depicts a cross-sectional view of the dumbbell assembly of FIG. 6A.

FIGS. 6C and 6D depict fully exploded and partially exploded views, respectively, of the dumbbell assembly of FIG. 6A.

FIG. 6E depicts a cross-sectional view of a sub-assembly including two weights of the dumbbell assembly of FIG. 6A.

Figures 1A, 1B, 1C:
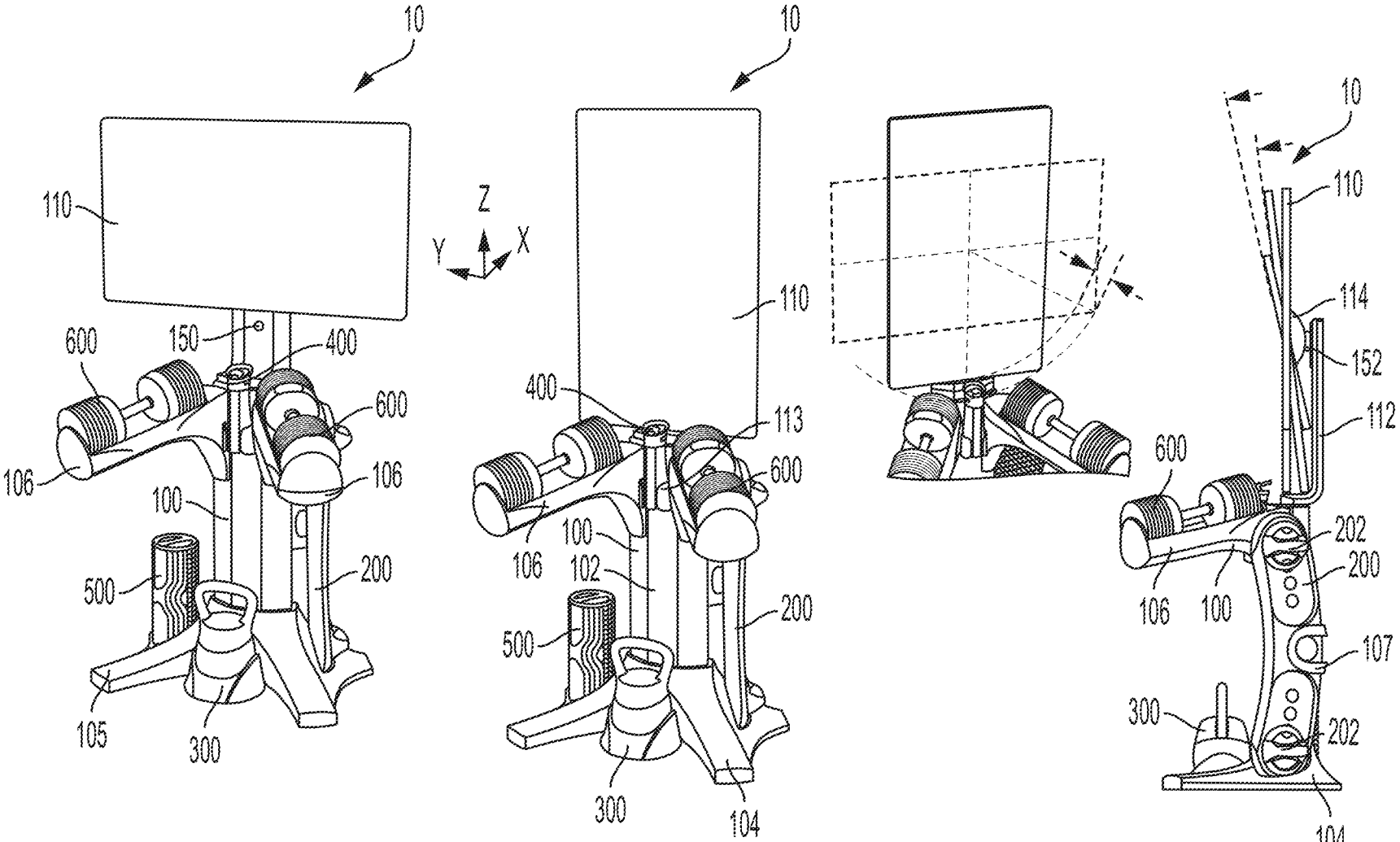
Figure 1E:
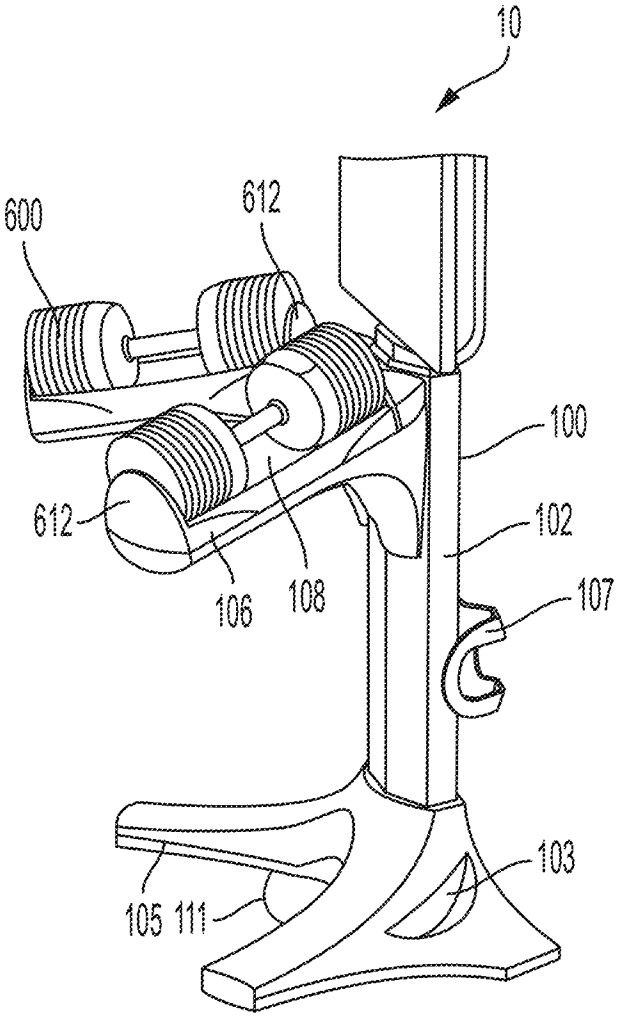
Figure 1D:
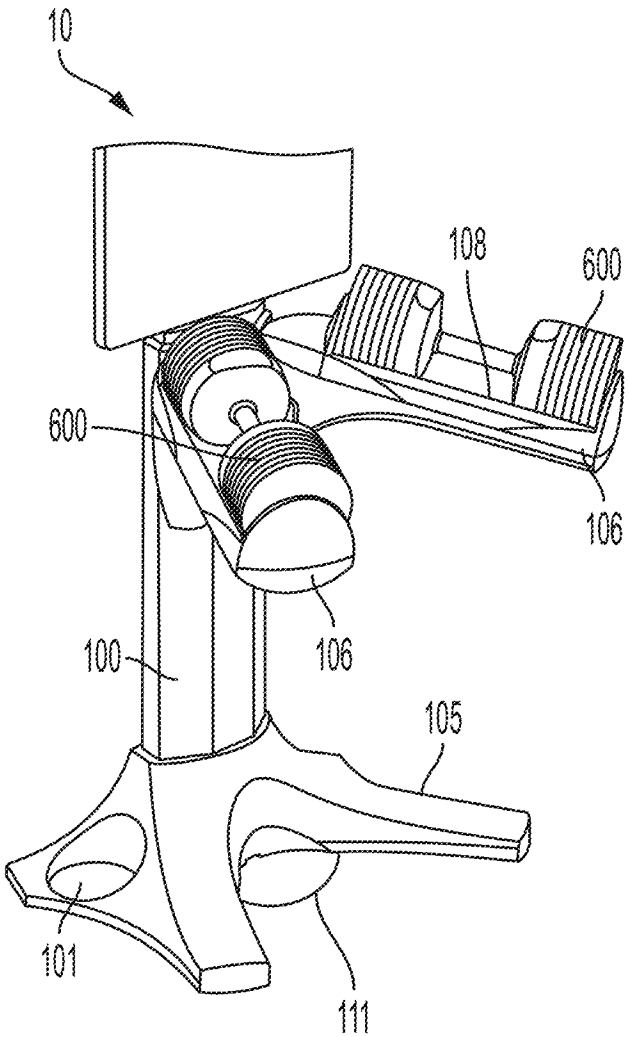
Figure 7:
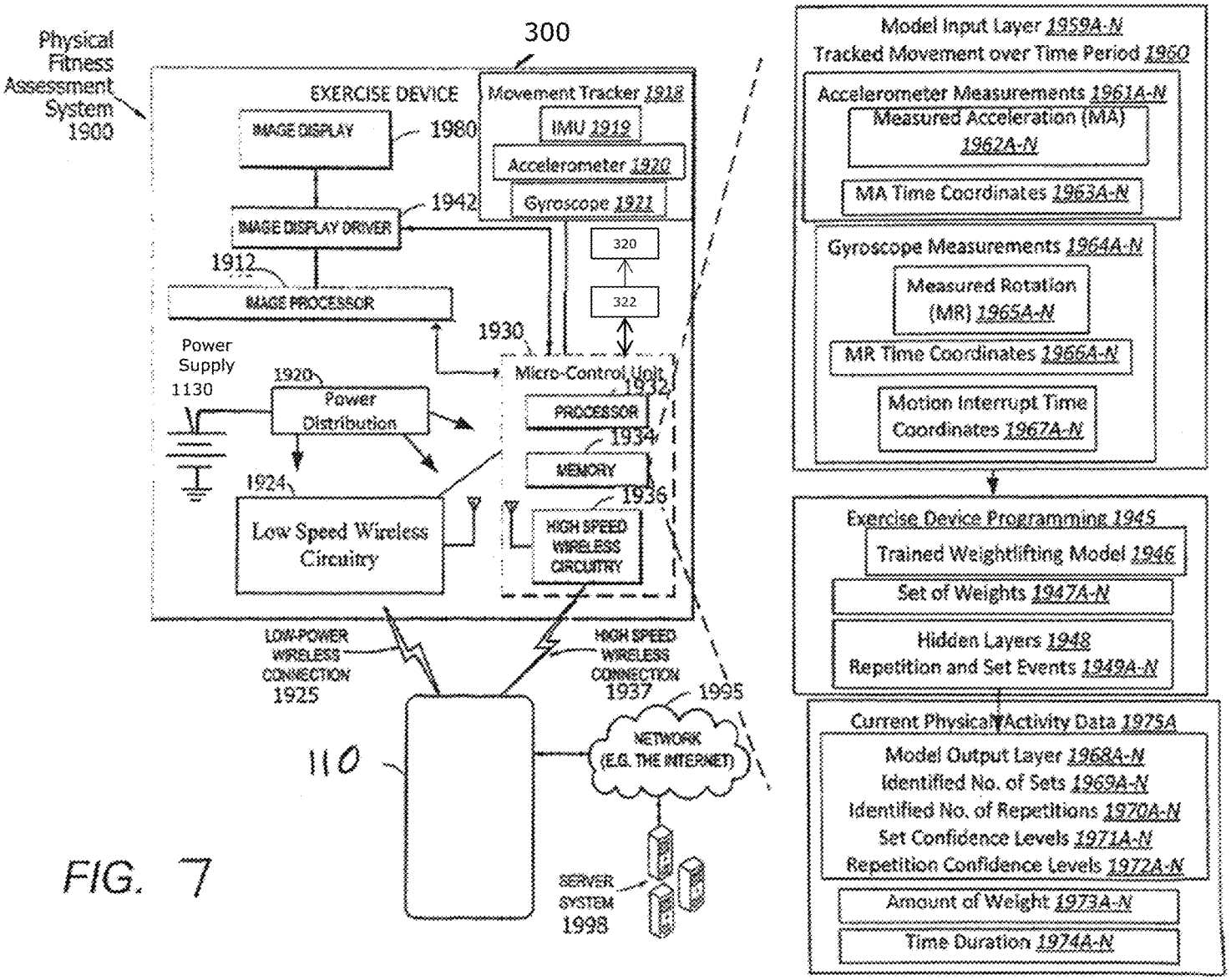

FIG. 7 is a high-level functional block diagram of an example of a physical fitness assessment system for the system of FIG. 1A including one of the exercise devices of the system that includes a sensor (e.g., a movement tracker), the computing device of the system of FIG. 1A, and a server system connected via various networks.

Figure 8:
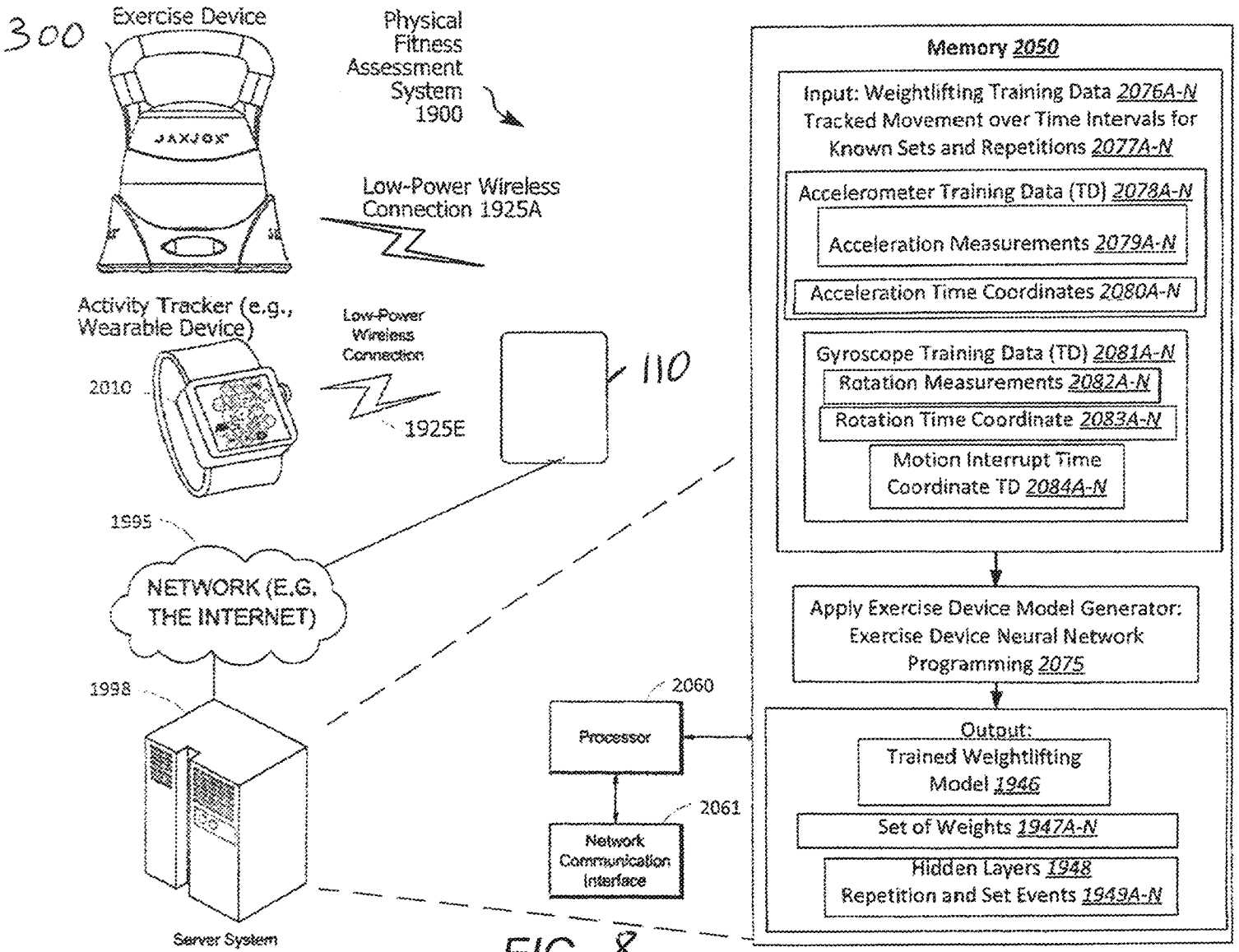

FIG. 8 shows an example of a hardware configuration for the server system of FIG. 7, for example, to build a neural network model for the exercise device, in simplified block diagram form, and an activity tracker (e.g., a wearable device).

Figure 9:
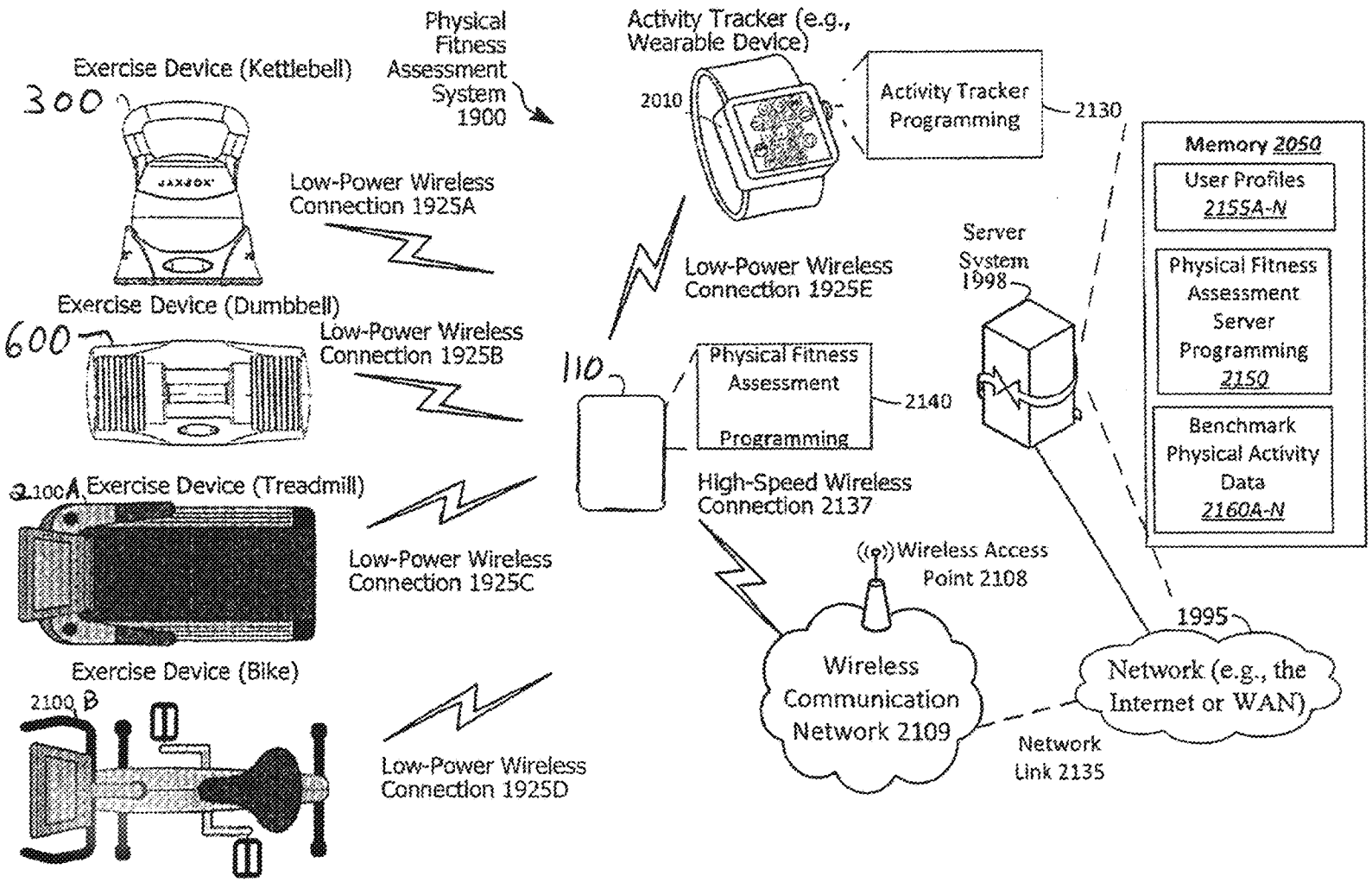

FIG. 9 is a high-level functional block diagram of an exemplary physical fitness assessment system including multiple exercise devices (including those of the system of FIG. 1A), the computing device of FIG. 1A, an activity tracker (e.g., a wearable device), and a server system connected via various networks.

Figure 10:
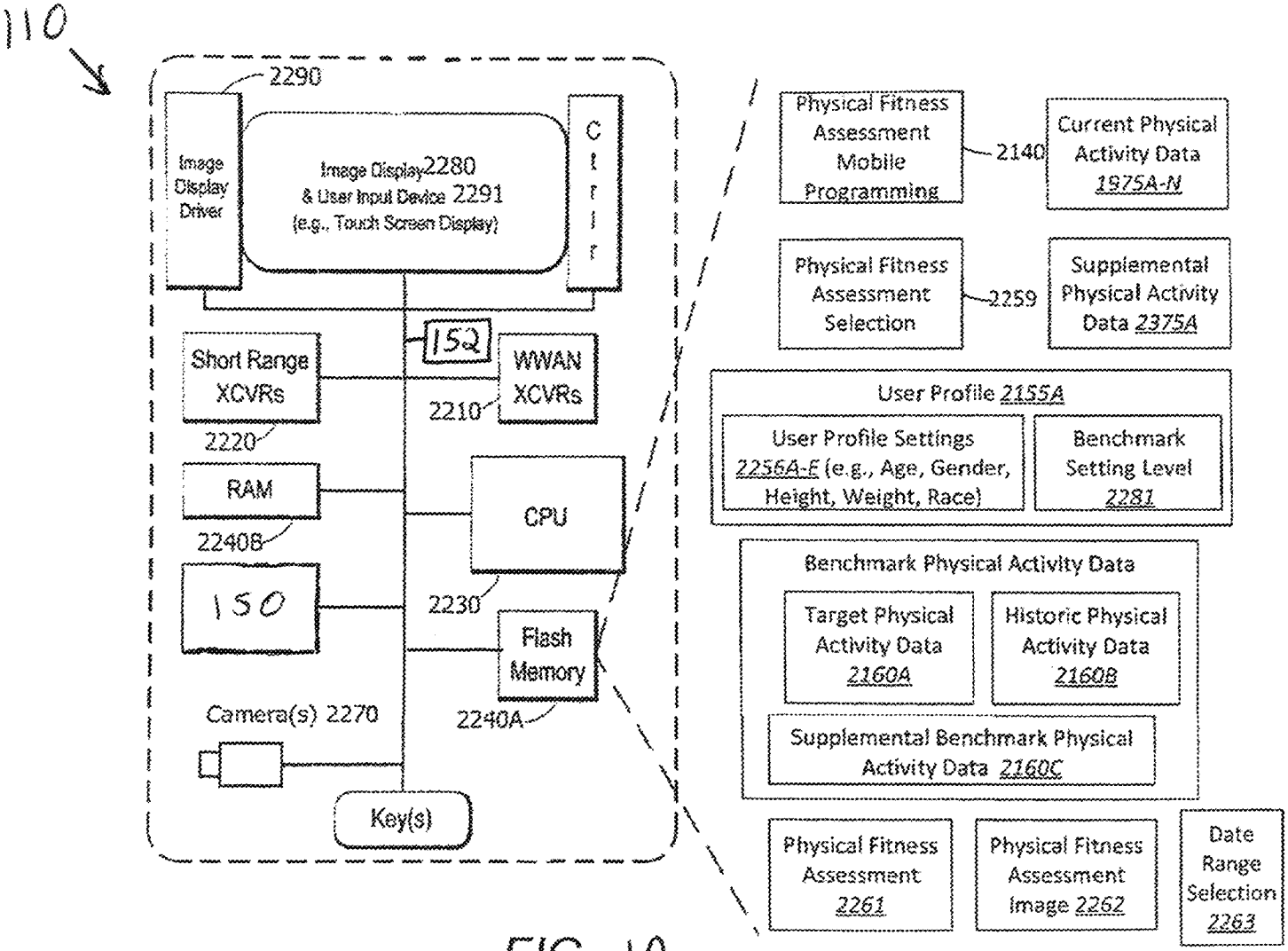

FIG. 10 shows an example of a hardware configuration for the computing device of the system of FIG. 1A.

Figure 11:
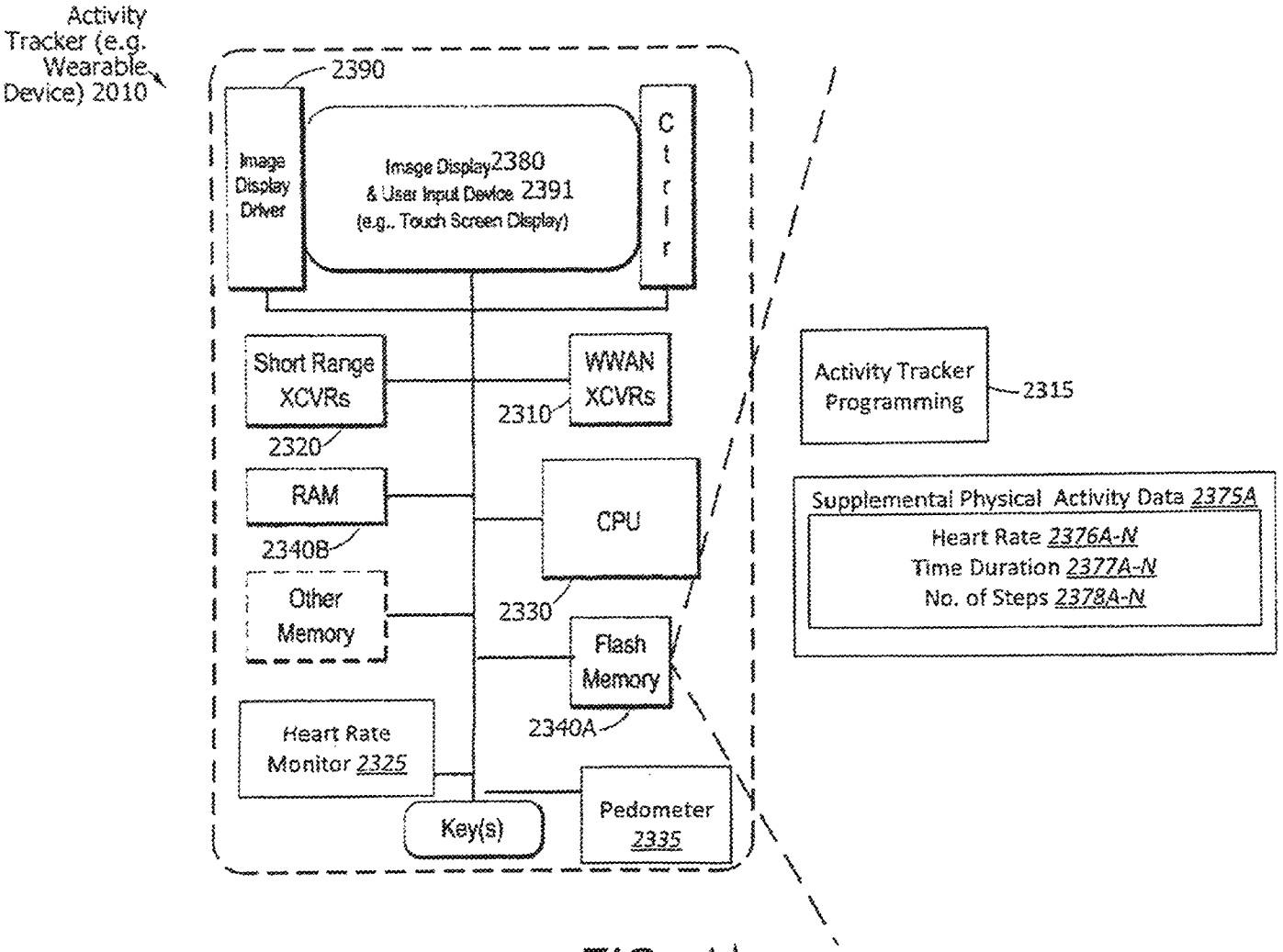

FIG. 11 shows an example of a hardware configuration for the activity tracker of the physical fitness assessment systems of FIGS. 8 and 9.

Figure 12:
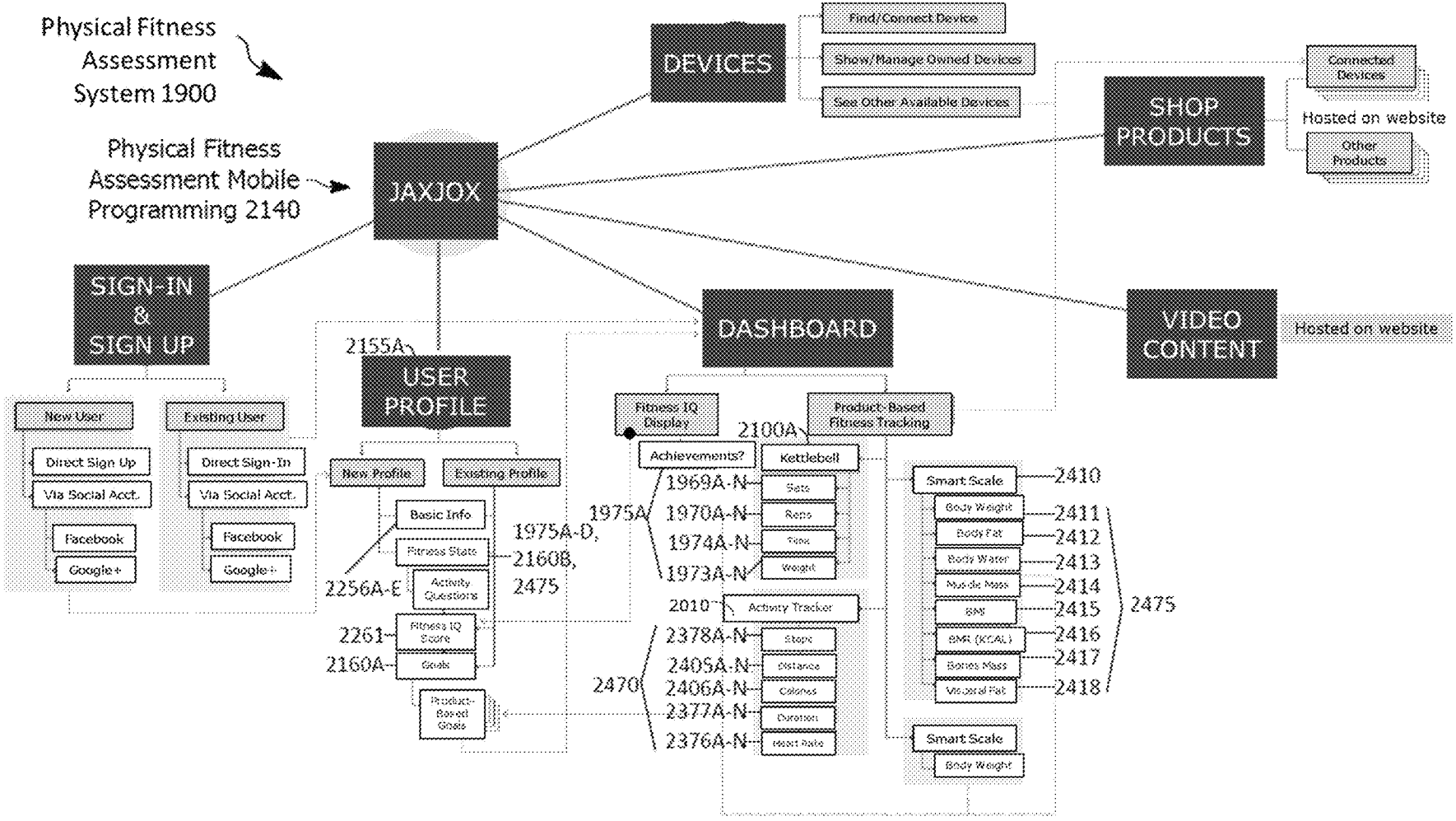

FIG. 12 shows an example of a schematic diagram of the information architecture of the physical fitness assessment system of FIGS. 7-9.

Figure 13:
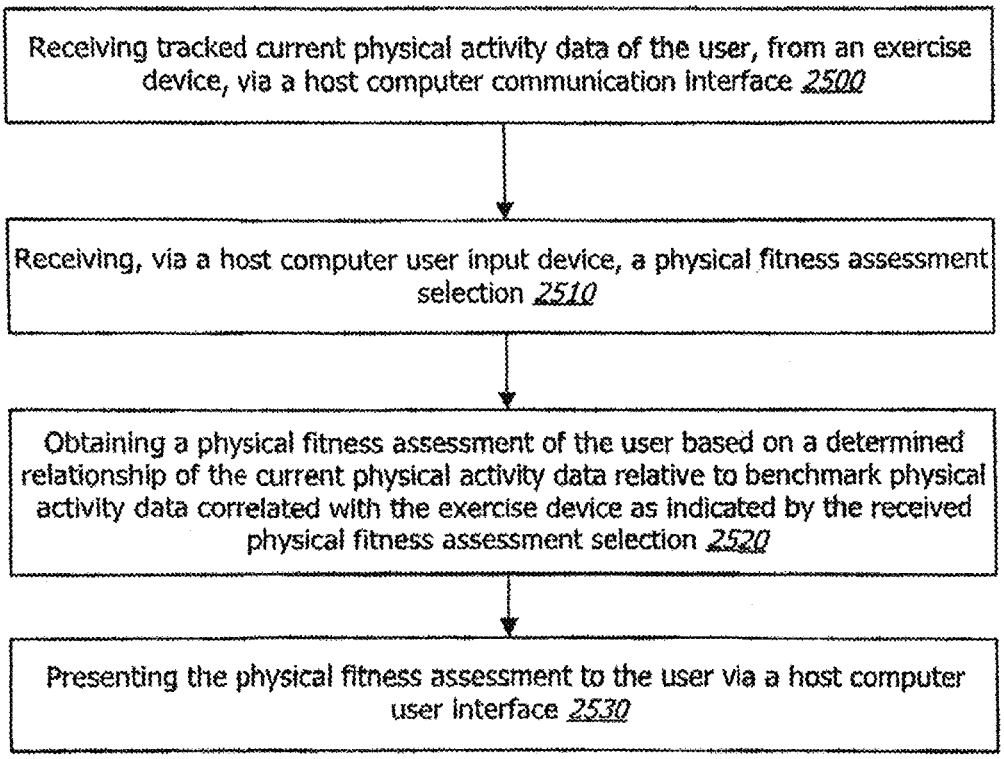

FIG. 13 is a flow diagram that shows an example of a method of providing a physical fitness assessment to a user.

Figure 14:
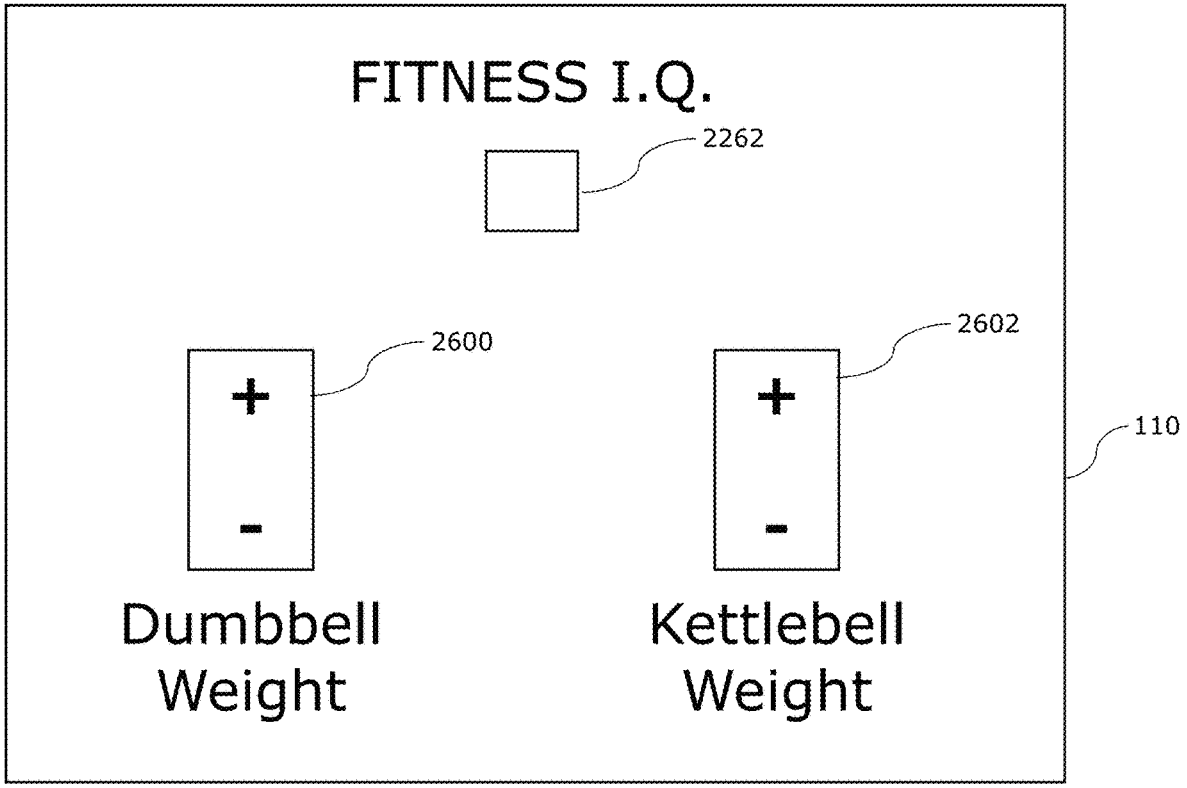

FIG. 14 is a simplified graphical user interface (GUI) of the computing device of the system of FIG. 1A.

DETAILED DESCRIPTION OF EMBODIMENTS OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

According to aspects of this invention, an interactive physical fitness system is provided that incorporates multiple exercise devices (e.g., dumbbell, kettlebell, etc.) and is capable of (i) adjusting the weight or intensity of one or more of the multiple exercise devices in an automated fashion, (ii) monitoring a user's physical condition and progress using the exercise devices, (iii) displaying the user's physical condition and progress to the user in the form of real-time exercise data (e.g., number of reps and weight), and/or (iv) connecting the user to personal trainers, live and on-demand exercise classes and/or other users.

This invention makes it possible to provide an interactive fitness studio or wellness hub. By interconnecting (physically and/or by communication) exercise devices and a monitoring system, it is possible to provide an interactive system for assessing, improving, and/or communicating regarding the overall fitness of a user.

Generally referring to the figures, and according to one aspect of the invention, a physical fitness system comprises a computing device 110; a stand assembly 100 including a stand, a display 110/2280 mounted to the stand, and at least one integrated docking station 111/106 for receiving an exercise device; and at least one exercise device (e.g., a kettlebell, a dumbbell, a roller, and a push-up bar) that is configured to be releasably mounted to the docking station on the stand, wherein the at least one exercise device is configured to communicate with the computing device 110.

According to another aspect of the invention, a physical fitness system 10 includes a stand assembly including a stand 100, a computing device 110 mounted on the stand 100, and at least one integrated docking station 111/106 for receiving an exercise device (e.g., a kettlebell, a dumbbell, a roller, and a push-up bar). The computing device 110 has (i) a user input 2291 for inputting instructions to the computing device relating to the exercise device, (ii) a system network communication interface (short range transceivers 2220 and wireless area network transceivers 2210) for communication over a network, and (iii) a system computer processor 2230 coupled to the user input and the system network communication interface. At least one exercise device 300 is configured to be releasably mounted to the docking station, said exercise device including (i) a driver 320 for selectively changing either a resistance applied to the exercise device or a weight carried by the exercise device, (ii) an exercise device network communication interface 1924/1936 for communication over the network, and (iii) an exercise device processor 1932 coupled to the exercise device network communication interface and the driver. Upon receiving instructions from the user input, the system computer processor 1932 is configured to transmit instructions over the network from the system network communication interface 2210/2220 to the exercise device network communication interface 1924/1936, and upon receiving the instructions, the exercise device processor 1932 is configured to activate the driver 320 to change either the resistance applied to the exercise device 300 or the weight carried by the exercise device.

According to another aspect of the invention, a physical fitness system includes a stand 100 having docking stations 111/106 each positioned to receive an exercise device. Exercise devices 300/600 are each received by and configured to be releasably mounted to a respective one of the docking stations of the stand. At least one of the exercise devices differs from another one of the other exercise devices (e.g. one of the exercise devices may be a kettlebell 300 and another one of the exercise devices may be a dumbbell 600). At least one of the exercise devices is an adjustable exercise device including (i) a driver 320 for selectively changing either a resistance applied to the exercise device or a weight carried by the exercise device, (ii) an exercise device network communication interface 1924/1936 for communication over the network, and (iii) an exercise device processor 1932 coupled to the exercise device network communication interface and the driver 320. A computing device 110 is mounted to the stand 100, the computing device having (i) a user input 2291 for inputting instructions to the computing device relating to the adjustable exercise device, (ii) a system network communication interface 2210/2220 for communication over a network, and (iii) a system computer processor 2230 coupled to the user input 2291 and the system network communication interface 2210/2220. Upon receiving instructions from the user input 2291, the system computer processor 2230 is configured to transmit instructions over the network from the system network communication interface 2210/2220 to the exercise device network communication interface 1924/1936. Upon receiving the instructions, the exercise device processor 1932 is configured to activate the driver 320 to change either the resistance applied to the exercise device or the weight carried by the exercise device 300. Each of the exercise devices includes a sensor 662 configured to detect use of the exercise device and a transmitter 1924/1936 configured to transmit, to the computing device, the use detected by the sensor 1918 or 662. The computing device 110 is configured to receive, from each of the exercise devices, the use detected by the sensors 1918 or 662 of the exercise devices and to display a physical fitness assessment based upon the use detected by the sensors of the exercise devices. The exercise devices are selected from a kettlebell, a dumbbell, a push-up bar, a roller, or a combination thereof. And, the adjustable exercise device is selected from a kettlebell and a dumbbell.

FIGS. 1A-1E depict an interactive physical fitness system 10 (system 10, hereinafter) according to one exemplary embodiment of the invention. System 10 generally comprises a stand 100 to which other components are mounted including a computing device 110 having a display monitor, a push-up bar 200, a kettlebell 300, a water bottle 400, a foam pad roller 500, and two dumbbells 600.

Stand 100 comprises a vertically extending central frame member 102, a base member 104 having radially extending legs 105 (two shown) for supporting system 10 on a floor surface (not shown), and two radially extending arms 106 extending from the top end of frame member 102. Frame member 102 may have a cross-section that is polygonal (as shown), circular, square, rectangular, hexagon, etc. Arms 106 and legs 105 generally extend in the same radial direction from frame member 102. An acute angle is defined between arms 106, and, an acute angle is also defined between legs 105. Base member 104 and arms 106 may be integral with frame member 102, or those components may be separate components that are releasably or fixedly mounted to frame member 102.

Each arm 106 is configured to releasably receive one of the dumbbells 600. Specifically, a housing 612 for the dumbbell 600 is releasably attached to the arm 106, as will be explained in greater detail in relation to FIG. 6. One or more electrical ports may (optionally) be provided on the arm 106 for transferring power and/or signals between system 10 and dumbbells 600. Alternatively, the housing 612 may be either non-removably attached to or integrated with arm 106.

A mount 107 is defined on one side of frame member 102 for retaining push-up bar 200 to stand 100. Additionally, a scalloped recess 103 is defined in base member 104 for receiving and retaining one end of push-up bar 200. Mount 107 and recess 103 together retain push-up bar 200 in a releasable manner. One or more electrical terminals may (optionally) be provided on mount 107 and/or recess 103 for transferring power and/or signals between system 10 and push-up bar 200.

An opening 101 in the form of a circular hole is provided in base member 104 for accommodating foam pad roller 500 in a releasable manner. One or more electrical terminals may (optionally) be provided on or adjacent opening 101 for transferring power and/or signals between system 10 and foam pad roller 500.

A mating surface 111 is formed on base member 104 at the intersection of legs 105 and is sized for accommodating the bottom surface of kettlebell 300. One or more electrical terminals may (optionally) be provided on or adjacent mating surface 111 for transferring power and/or signals between system 10 and kettlebell 300.

Elements 101, 103, 107, 108, 111 may be referred to herein as docking surfaces or docking ports. Each docking port may include a wireless charging port for wirelessly charging the devices 200, 300, 500 and 600 using the AC power delivered into stand 100 by an electrical plug when those devices are mounted to the stand 100. The wireless charging port may include an exposed electrical contact, for example. Thus, electrical contacts may be provided at each docking port, and the devices 200, 300, 500 and 600 may have mating electrical contacts. Signals may also be transmitted between the devices 200, 300, 500 and the stand 100 using those electrical contacts (or additional contacts) for transferring data from stand 100 to/from the devices. The devices 200, 300, 500 and 600 are DC powered, and are removable from their respective docking ports. Devices 200, 300, 500 and 600 either are or may be portable devices that may be utilized in the absence of the stand 100.

As best shown in FIG. 1B, a mount 113 in the form of a C-clip, for example, is defined on the front side of frame member 102 for retaining water bottle 400 thereto. It should be understood that water bottle 400 may be releasably mounted to frame member 102 in a variety of ways.

Computing device 110 is mounted to the top end of the stand 100 by an L-shaped bent bracket 112. Computing device 110 is mounted to bracket 112 by a swivel mount 114 such that computing device 110 can be rotated between the portrait and landscape positions shown in FIGS. 1A and 1B. Computing device 110 is also capable of being pivoted on swivel mount 114 about X, Y and/or Z axes to the multiple positions shown in FIG. 1C. One or more motors 152 (e.g., an XYZ linear stage supplied by mks Newport Corporation) are interconnected between the computing device 110 and the stand 110 for pivoting the computing device 110 on swivel mount 114 about X, Y and/or Z axes Computing device 110 has, among other features, an integrated processor (CPU 2230) and an integrated display/monitor that is positioned to face a user of system 10 at the front side of system 10. Computing device 110 may (optionally) have a touch screen (capacitive, resistive, surface acoustic wave, infrared, etc.), or it may be voice-activated, controlled by buttons on the bezel, remote controlled, or wirelessly controlled using a wireless device (e.g., smart phone or smart watch), for example.

One or more optical sensors 150 are mounted on the stand 100 and are oriented to face a user positioned before the display monitor of the computing device 110. The optical sensors 150 may be infrared (IR) or 3D sensors that are configured to track the position of the user. As best shown in FIG. 10, signals from the optical sensors 150 are transmitted to the CPU 2230. CPU 2230 determines the position of the user based upon those signals (sitting, standing, kneeling, etc.). CPU 2230 then transmits a signal to activate motors 152 such that the display monitor is positioned to face the user. A method of tracking a target (i.e., user) in space using a camera is described in greater detail in U.S. Pat. No. 7,974,443, which is incorporated by reference herein in its entirety.

Further details of the computing device 110 are described with reference to FIGS. 7-12.

Reference will now be made to the individual exercise devices 200-600 of system 10.

Figure 2:
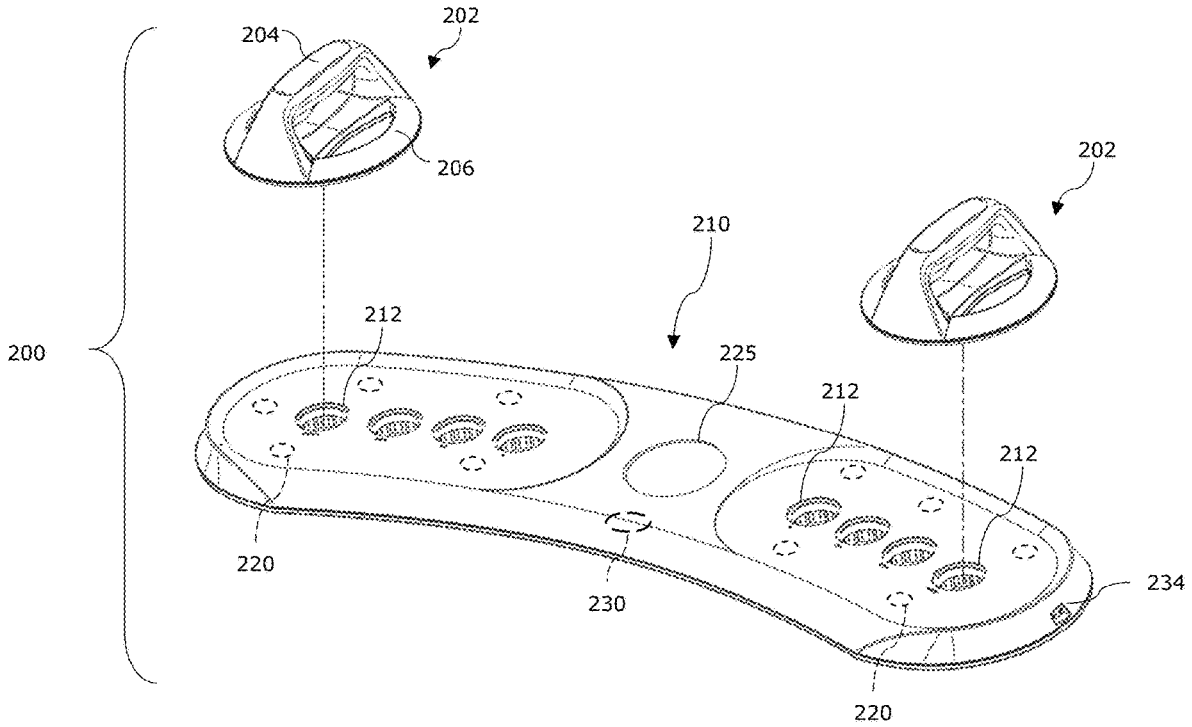

FIG. 2 depicts a push-up bar assembly 200, which generally comprises an exercise device for use in a push-up type exercise. The assembly 200 includes a pair of push-up bars 202 each comprising a frame 206 and handle 204 connected to the frame 206 that is configured to be grasped by a user. The assembly 200 further includes base assembly 210 having a plurality of recesses 212 each being configured to receive a protrusion (not shown) on the underside of one of the bars 202. Interaction between the recess 212 and the protrusion limits movement of the bar 202 relative to the base assembly 210 when the bar 202 is connected to the base assembly 210. A plurality of pressure sensors 220 are disposed on the base assembly 210. The sensors 220 are each configured to measure the amount of force or pressure applied to the device when the user performs the push-up type exercise. An infrared (IR) proximity sensor 225 is also positioned on the base assembly 210 to detect and track motion of the user. The sensors 220 and 225 are connected to a computing unit 230 of the assembly 200 having (at least) a transceiver, memory and processor. The computing unit 230 is configured to track the exercise activities of the user and communicate (via the transceiver) the exercise activities of the user to the computing device 110 of the system 10. An electrical terminal 234 is disposed on a surface of the base assembly 210 for mating with a mating electrical terminal on the stand 100 to enable wireless charging of the assembly 200.

Further details of push-up bar assembly 200 are disclosed in U.S. patent application Ser. No. 16/998,640, filed Aug. 20, 2020, which is incorporated by reference herein in its entirety and for all purposes.

Figure 3:
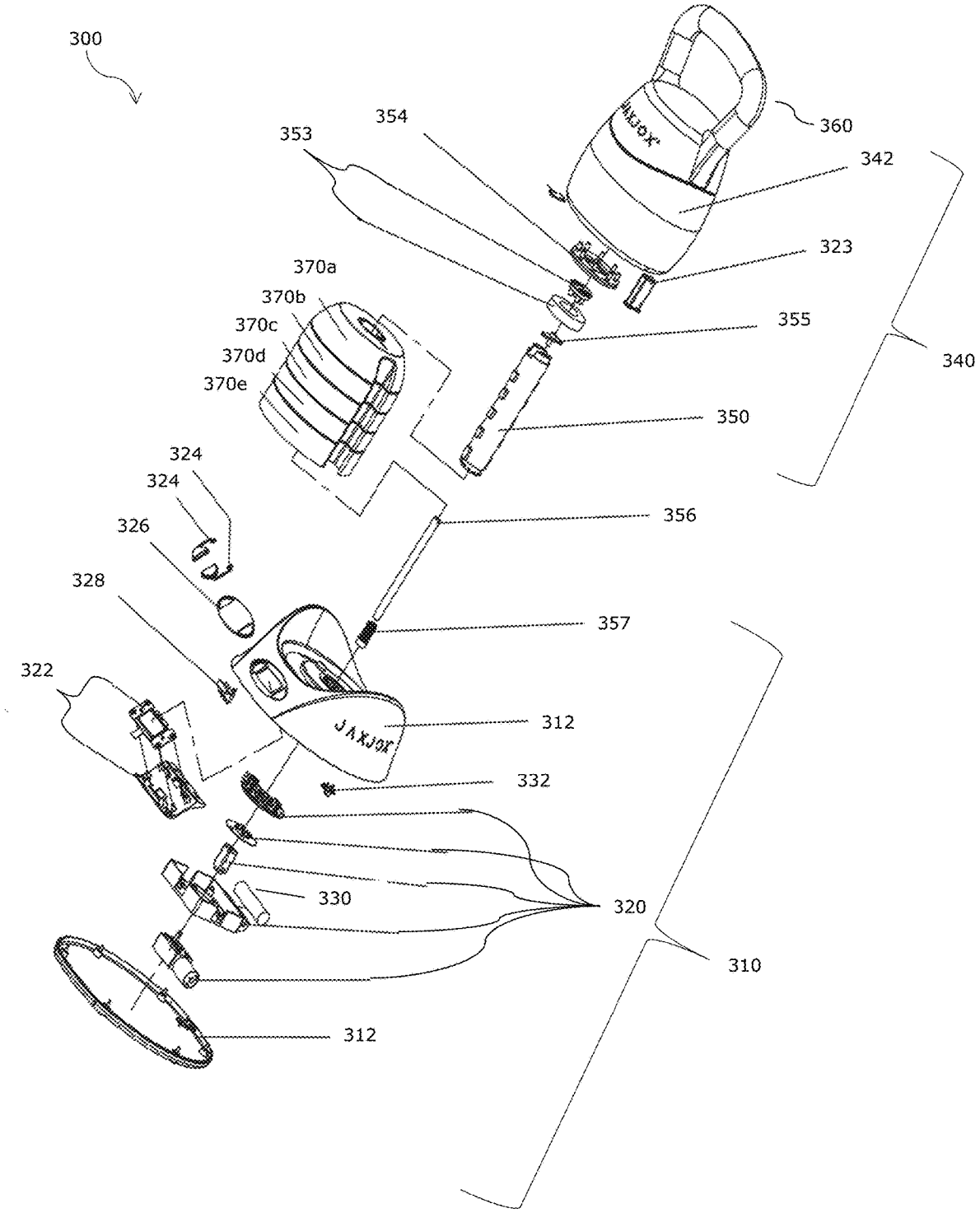
Figure 4:
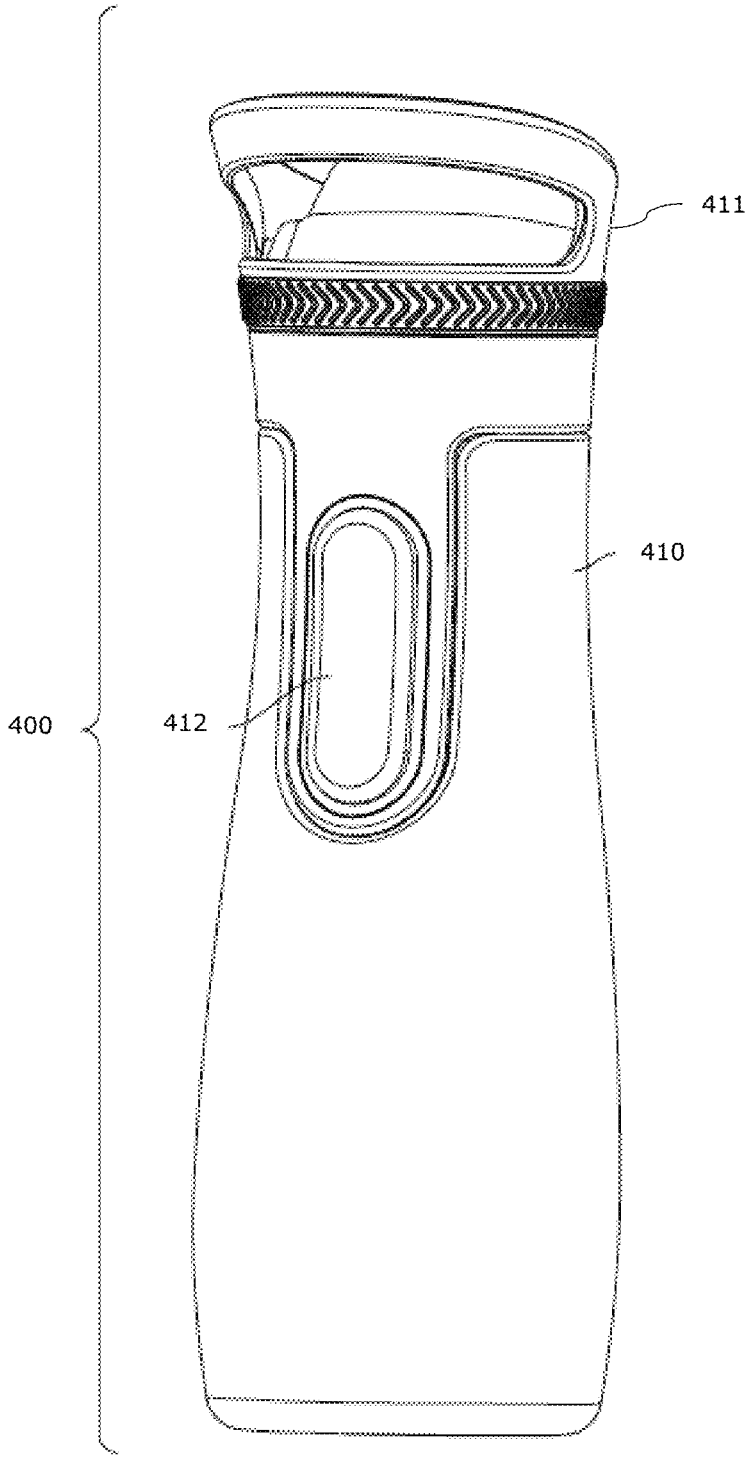

FIG. 3 depicts kettlebell 300, which generally includes a base assembly 310, a shell assembly 340, and a plurality of weights 370*a*-370*e* (referred to collectively or individually as weights 370). Base assembly 310 has a housing 312 which includes a support surface for weights 370. Base assembly 310 houses a driver 320, which may be a motor having an output shaft. Driver 320 is configured to be coupled to and decoupled from a shaft 350 of shell assembly 340. Driver 320 is further configured to move, e.g. rotate, the shaft 350 of shell assembly 340. A controller 322 electrically controls driver 320 to operate, e.g., to rotate, shaft 350 when shaft 350 is coupled to driver 320. The controller 322 may operate driver 320 automatically, or in response to some input, e.g., input from a user of kettlebell 300, system 10 or another exercise device.

Controller 322 may be in communication with a sensor 323. Sensor 323 is configured to detect when driver 320 is coupled to or decoupled from shaft 350 of shell assembly 340. Controller 322 may thus operate driver 320 only when sensor 323 signals that driver 320 is coupled to shaft 350 or that one or more surfaces of the base assembly 310, support or are adjacent to the shell assembly 340 and/or weights 370. Suitable sensors for use as sensor 323 include, for example, optical sensors, pressure sensors, or electrical sensors.

Base assembly 310 may further comprise an input device 324. Input device 324 receives input from a user of kettlebell 300. Input device 324 is electrically and/or mechanically coupled to driver 320 to cause driver 320 to rotate shaft 350 based on input by the user of kettlebell. The input may comprise a selection of a type of weight training exercise, an amount of weight, or a number of weights 370. Controller 322 may then control driver 320 based on the type of weight training exercise, an amount of weight, or a number of weights 370 received by input device 324. Base assembly 310 may further comprise a display 326. Display 326 is configured to display the input, e.g., the selected exercise, amount of weight, or selected number of weights 370 provided by the user to input device 324 of system 10. Base assembly 310 may further comprise a communication device 328. Communication device 328 is configured to wirelessly communicate with system 10, another exercise device, and/or with other wireless transceivers. Data received via communication device 328 may be used to control the operation of driver 320.

A power supply 330 (such as a rechargeable battery) may be provided in base assembly 310 or shell assembly 340 for powering the electrical components of kettlebell 300. Alternatively, kettlebell 300 may be provided with power through one or more power/communication terminals 332 formed on base assembly 310 or via a port or cable connection. For example, terminal 332 may be releasably connected to an electrical contact at surface 111 of stand 100 for transferring power and/or signals between kettlebell 300 and system 10. Kettlebell 300 may be configured to be primarily powered through terminals 332, or may use power connections through terminals 332 for recharging power supply, e.g., when power supply 330 is a rechargeable battery.

Shell assembly 340 has the shape of a kettlebell and is grasped and lifted by a user. Shell assembly 340 includes a shell 342. Shell 342 defines an interior space, which is sized to receive weights 370. Shell assembly 340 further includes shaft 350. Shaft 350 extends within the interior space of shell 342. Rotation of shaft 350 when weights 370 are received within the interior space may couple shaft 350 with one or more of weight 370. Shaft 350 is configured to be coupled to driver 320 when shell assembly 340 is supported on base assembly 310. Shaft 350 is also configured to be decoupled from driver 320 when shell assembly 340 is removed from base assembly 310, e.g., when a user lifts shell assembly 340 off of base assembly 310 during a weight training exercise. Shaft 350 includes projections for engaging with corresponding structures on weights 370.

At the upper end of shaft 350, shell assembly 340 may further include one or more bearings 353 to enable rotation of shaft 350 relative to shell 342. Bearings 353 are coupled to shell assembly 340 by an upper fixed plate 354, and are coupled to shaft 350 by a fixed positional plate 355. At the lower end of shaft 350, shaft 350 is configured to be coupled to driver 320 by way of a linkage including a connecting rod 356 and a fixed block 357 having a spring. Shell assembly 340 may further comprise a handle 360 positioned to be grasped by the user during the weight training exercise.

When the user is ready to begin the exercise, the user may provide the appropriate input via either input device 324 or via communication device 328 (as will be explained below). The input may comprise a selection of a type of weight training exercise, an amount of weight, or a number of weights 370. Alternatively, or in addition to input device 324, driver 320 may operate in response to the receipt of a communication by communication device 328, which can receive signals from computing device 110 of system 10 or other device. The user may wirelessly transmit a selection of a type of weight training exercise, an amount of weight, or a number of weights 370 to communication device 328, e.g., using the system 10 or the user's smartphone, for example. Upon receipt of this data, controller 322 electrically controls driver 320 to rotate shaft 350 based on the data received from communication device 328.

Responsive to receiving this input from input device 324 or system 10, driver 320 automatically moves shaft 350 to engage with a number of weights 370 corresponding to the input. Controller 322 controls driver 320 to rotate shaft 350 and, consequently, selectively couple shaft 350 with the appropriate number of weights 370. Rotation of shaft 350 by driver 320 causes one or more of the projections to selectively engage with corresponding ledges on weight 370. The number of ledges which are engaged by projection 352 is dependent on the rotational position of shaft 350. As such, driver 320 may control the number of weights 370 which are engaged with shaft 350 by controlling the rotational position of shaft 350.

When shaft 350 is rotated to the correct rotational position, and the appropriate number of weights 370 are engaged with shaft 350, shaft 350 may be decoupled from driver 320 by lifting shell assembly 340 off of base assembly 310, e.g., by a user grasping handle 360 and lifting shell assembly 340. The user of exercise device 300 may then perform a desired weight training exercise with kettlebell 300. As will be described with reference to FIG. 9, kettlebell 300 is configured to transmit real-time exercise data to computing device 110 of system 10 via communication device 328, for example.

Further details of kettlebell 300 are disclosed in U.S. Pat. No. 10,099,083, which is incorporated by reference herein in its entirety and for all purposes.

Water bottle 400, which is not necessarily considered an 'exercise device,' is a fitness bottle that can contain a liquid. The bottle is openable and closeable by one hand of a user during exercise. Water bottle 400 includes a hollow vessel 410, a removable cap 411, and an open/close mechanism 412 whereby a push of a button serves to open the bottle if it is closed, or to close the bottle if it is open. Further details of water bottle 400 are disclosed in U.S. Patent App. Pub. No. 20200172304, which is incorporated by reference herein in its entirety and for all purposes. Mount 113 is especially suited to releasably retain water bottle 400 in a removable manner. Alternatively, water bottle 400 may vary from that shown and described, and could be a conventional bottle.

Figure 5:
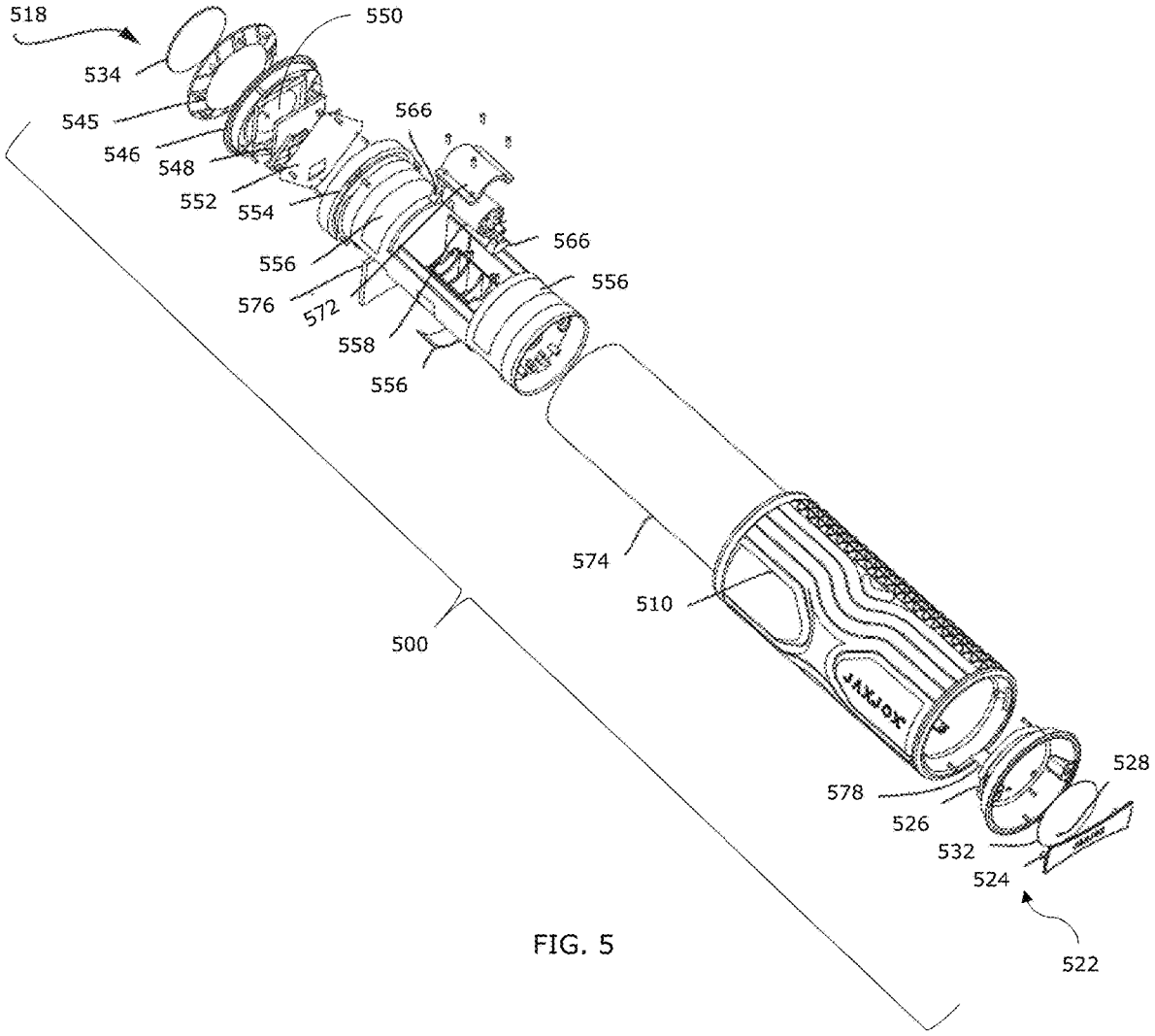

FIG. 5 depicts the foam pad roller 500, which is a cylinder having an exterior surface 510 comprising a foam, rubber or other soft and/or compressible material. Roller 500 has an input/display end 518 provided for manual entry and visual display of various aspects and operational parameters of the foam roller. A handle end 522 is opposite the input/display end 518. This handle end 522 comprises a handle 524 fixedly attached to a plastic end cap 526, which is itself fixedly attached to the roller 500. An electrical socket 528 is provided in an inlay 532 which is attached to the plastic end cap 526. The electrical socket 528 may be used to provide electrical power from an electrical source to charge an interior battery (not shown). As shown, the electrical socket 528 is in the form of a Universal Serial Bus (USB) micro B connection, but other connector types may alternatively be used. Roller 500 may be provided with power through socket 528 or via a port or cable connection. For example, the socket 528 may be releasably connected to an electrical contact disposed at opening 101 of system 10 for transferring power and/or signals between roller 500 and system 10.

In the center of the input display end is a display lens 534. The purpose of the display lens 534 is to protect the display module which is located behind the display lens 534. Surrounding the display lens 534 is an annular button 545, which has four buttons (not shown) that are used for providing input to roller 500 and scrolling through selection menus. The buttons fit into a button backing plate 546, which supports and holds the buttons in place. The button backing plate 546 is also constructed and arranged to hold a display module 548 which interacts with the buttons. The display module 548 is connected to a main printed circuit board assembly (PCBA) 552. The main PCBA 552 interacts with the display module 548 and the buttons. The main PCBA 552 comprises (at least) a printed circuit board (PCA) (not shown) which comprises (at least) a processor, a microcontrol unit controller, a memory, and a high speed wireless circuitry network communication interface such as high speed wireless circuitry wireless transmitter/receiver for transmitting/receiving wireless signals, such as Bluetooth® or Wi-Fi via a wireless network. The PCBA 552 may be configured to wirelessly receive and transmit exercise related data to the computing device 110 of the system 10. For example, roller 500 may be activated by computing device 110, and activated in a specific heat and/or vibration mode, as will be explained below.

An inner core housing 554 is constructed and arranged to extend nearly the full length of and to fit into the interior of a foam supporting tube 574. The inner core housing 554 is constructed and arranged to hold various components securely within the interior of the roller 500. Surrounding the inner core housing 554 is the foam supporting tube 574. The foam supporting tube 574 is cylindrical, hollow and open at both ends. A plurality of pads or fillers such as sponges 556 are compression fit around the inner core housing 554 to prevent and cushion undesirable movement of the inner core housing 554 relative to the roller 500.

An electro-mechanical vibration motor 558 is among the components in the interior of the roller 500. A rechargeable battery 576 powers the vibration motor 558 and the main PCBA 552 and its components via wired connections (not shown). The vibration motor 558 is in communication via wire (not shown) with main PCBA 52 and thereby to another PCB (not shown) that controls the rotational or cyclic movement of the vibration motor 558.

Also visible are two eccentric weights 566 that are driven cyclically by the vibration motor 558. These eccentric weights 566 cause the vibration motor 558 to vibrate or generate vibratory movement and thereby effect a vibration of the roller 500, because the vibration motor is fixedly attached to the inner core housing 554 of the roller 500, by way of a motor holder 572. The rate and cycle time of the weights 566 as driven by the vibration motor 558, which is controlled by the programming in the controller on the PCB, thereby creates the intensity of the vibration which may vary over time.

The battery 576 is electrically connected to the charger PCBA 578. The charger PCBA 578 functions to monitor the amount of charge in the battery 576, to make sure that it is not over-charged and to send an alert signal to the display module 548 indicating that the battery 576 is low on power. The charger PCBA 578 is electrically connected (via a wired connection, not shown) to the electrical socket 528 located in the inlay 526.

Roller 500 may also include a heating or cooling device for influencing the temperature of the exterior of roller 500. The heating or cooling device may have a plurality of selectable temperature settings (e.g., cool, warm, hot).

Turning now to the operation of roller 500, the roller 500 is activated by selecting a button on button 545, or, alternatively, roller 500 may be activated using computing device 110 of system 10. The user can select either stored user data or new user data. The user then selects from manual or auto operation. If the user selects manual operation, the user then selects the vibration regimen desired, the duration that the vibration regimen should last, the intensity of the vibration regimen, and optionally a temperature setting. If the user selects automatic "auto" operation of the roller 500, the user enters the activity performed. Non-limiting examples of activities which the user may select from: e.g., leisure, massage, strength, hike, cycle, or run.

If the user selects auto operation, the user enters the activity performed. A processor located preferably on the main PCBA 552 determines the appropriate vibration regimen, from a library of such regimens stored in memory located on the main PCBA 552. The processor determines the appropriate vibration regimen depending on the activity that the user selected, as well as the user attributes (also called user data), such as sex, level of fitness, and weight of user. The processor may optionally also determine which muscle group should be targeted by the roller 500.

The processor uses the performed exercise activity to determine which muscle group to target. The processor then outputs the suggested targeted muscle group to the display 550 or to an external device such as computing device 110 of system 10, a smart phone, or to all of the above. The processor sends a vibratory control signal to the vibration motor 558 and the motor 558 thus performs the vibration regimen for the duration.

When the vibration regimen is completed, the processor stores the details of the vibration regimen in memory. The processor may optionally also output the details of the completed vibration regimen to an external computing device, such as system 10, mobile device or a computer.

Further details of roller 500 are disclosed in U.S. patent application Ser. No. 16/425,267 to Owusu, which is incorporated by reference herein in its entirety and for all purposes.

FIGS. 6A-6D depict one of the dumbbells 600 mounted to housing 612 of stand 100. Only one of the dumbbells 600 will be described hereinafter, however, it should be understood that both dumbbells 600 are structurally and functionally equivalent. Dumbbell 600 is an assembly that generally comprises a base assembly 638, a shell assembly 640, and a series of weights 670.

Referring now to base assembly 638, base assembly 638 comprises housing 612, motors 623 and shafts 627 that are each connected to one of the motors 623. The underside of housing 612 includes one or more clips or apertures that are configured to be releasably connected to one of the arms 106. An electrical contact may be provided on the lower surface of housing 612 for connecting to a mating electrical contact on arm 106 for wirelessly transmitting power (and/or signals) to dumbbell 600.

Housing 612 includes a first surface 614 and a second surface 616 on an upper portion thereof. Surfaces 614 and 616 form a base configured to support shell assembly 640 and weights 670. Each surface 614, 616 includes upwardly protruding ribs 617 that are uniformly spaced apart and configured to support weights 670, e.g., in a stacked orientation. The lower surface of a weight 670 is sized to fit between two adjacent ribs 617.

An interior region is defined within housing 612 which houses certain components for interacting with dumbbell 600 to modify the number of weights 670 that are attached to the dumbbell 600. A driver in the form of two motors 623 are mounted within the interior region of housing 612. The driver is configured to adjust the amount of weight applied to shell assembly 640 of dumbbell 600. Each motor 623 has an output shaft 625 that is configured to rotate about an axis. Each output shaft 625 is non-rotatably connected to an intermediate shaft 627 such that the shafts 625 and 627 rotate together. The lower end of each intermediate shaft 627 is fixed to one of output shafts 625 such that shafts 625 and 627 rotate together, and the upper end of each intermediate shaft 627 includes an opening that is configured to releasably receive a shaft 631. Unlike shaft 627, shaft 631 forms part of shell assembly 640. Said opening of shaft 627 is keyed to the lower end of shaft 631 such that shafts 631 and 627 rotate together. It should be understood that shafts 631 and 627 are capable of being regularly detached and reattached during operation of dumbbell 600.

The upper end of each intermediate shaft 627 is positioned within a hollow cylinder 633 that protrudes from the top surface of housing 612, such that opening 629 in shaft 627 is visible and accessible from the exterior of housing 612. A spring 635 is positioned between the top end of shaft 627 and the interior surface of cylinder 633 to center shaft 627 within cylinder 633 and also ensure a positive connection between shafts 627 and 631. The top end of each intermediate shaft 627 may be flush with the top surface of cylinder 633. Alternatively, the top end of each intermediate shaft 627 may be either slightly depressed or protruding with respect to the top surface of cylinder 633.

PCB 641 is mounted within housing 612 for controlling motors 623 based upon signals received from PCB 641, as will be described later. PCB 641 includes (at least) a processor, controller and a wireless transmitter/receiver for transmitting/receiving wireless signals, such as Bluetooth or Wi-Fi.

Referring now to shell assembly 640, shell assembly 640 is essentially a barbell without any weights 670 applied thereto. Shell assembly 640 generally includes a handle shaft 642 in the form of a hollow cylinder, a two-piece telescopic shaft 644 positioned within the hollow interior of handle shaft 642, and two shell sub-assemblies 645 mounted to opposing sides of shaft 642. Shell sub-assemblies 645 are substantially identical and only one of the shell sub-assemblies 645 will be described hereinafter. Shell sub-assembly 645 generally includes a shell comprising a bowl-shaped cylindrical inner case 646, which is positioned closest to an end of shaft 642, an outer case 648 that is mounted to the open end of inner case 646, and a female dovetail connector 650 that is mounted to an exterior facing surface of outer case 648. A circular opening is formed through each shell sub-assembly and is substantially aligned with the longitudinal axis B.

Outer case 648 comprises a hollow cylinder in which one end of the shaft 642 is received. Shaft 642 is fixedly and non-rotatably mounted to cylinder 648 by the shafts 631 that pass through holes 663 in shaft 642. Outer case 648 includes a series of snap connection features 655 that are releasably connected to mating features on inner case 646 for fastening the cases 646 and 648 together.

A series of mechanical components are positioned within the hollow region defined between cases 646 and 648. More particularly, and referring still to only one of the substantially identical shell sub-assemblies 645, the shaft 631 is rotatably mounted within the hollow region. Shaft 631 registers with (i.e., passes through) opposing holes 653 in handle shaft 642 and opposing holes 656 in cylinder 648 of outer case 648. A c-clip 660 is mounted in a groove formed in shaft 631 at a location above cylinder 648, and another c-clip 660 is mounted in a groove formed in shaft 631 at a location below cylinder 648, thereby locking the axial position of shaft 631 with respect to handle shaft 642. It should be understood that shaft 631 is capable of rotating within holes 663 and 666, but does not translate relative to holes 663 and 666.

A toothed gear 661 is non-rotatably mounted to a central region of shaft 631 such that shaft 631 and gear 661 rotate together. Gear 661 and shaft 631 together form a drive shaft assembly. Gear 661 may be capable of translating to a slight degree along the length of shaft 631 (i.e., along axis A) to accommodate for misalignment between gear 661 and the toothed gear rack 672 on shaft 644 with which gear 661 is meshed.

Referring now to the features of telescopic shafts 644*a* and 644*b* (referred to collectively or individually as shaft(s) 644) of shell assembly 640, each telescopic shaft 644 has a substantially cylindrical shape having a cut-out region that defines a half-cylindrical section along a majority of the length of shaft 644. A rectangular channel 674 is formed along the length of the interior facing side (i.e., the side facing axis B) of the half-cylindrical section. Gear teeth forming a toothed gear rack 672 are defined along a substantial portion of the channel 674. In assembled form, the flat faces of the half-cylindrical sections are positioned to face each other. Each gear 661 is positioned within the channels 674 of both shafts 644, and the teeth of each gear 661 are meshed with both toothed gear racks 672, such that rotation of at least one of gears 661 about axis A (FIG. 6B) causes translation of both shafts 644 along axis B. In normal operation, both gears 661 are rotated at the same time by motors 623 to cause translation of both shafts 644 along axis B. Due to the toothed engagement between the gears 661 and the toothed gear racks 672, the shafts 644 are configured to simultaneously translate in opposite directions. Shafts 644 are configured to move between a retracted position in which shafts 644 do not engage any weights 670, and a deployed position in which shafts 644 engage one or more weights 670.

Referring back to the features of the shell sub-assemblies 645, for one of the shell sub-assemblies 645, electronic components are also accommodated in the hollow region that is defined between cases 646 and 648. The electronic components include (i) a sensor 652 in the form of an accelerometer (for example) that senses motion of dumbbell 600, (ii) a rechargeable battery for powering sensor 652, and (iii) a PCB including memory and a processor for communicating readings of sensor 652 to computing device 10 of system 10 or another system. Spring pins 657 (also referred to as contacts) are connected to the PCB of shell sub-assembly 645 to transfer signals and power to and from PCB 641 in a docked state of shell assembly 640.

Female dovetail connector 650 of the shell sub-assembly 645 is mounted to an exterior facing surface of outer case 648, and is configured to be releasably mounted over a male dovetail connector 680 that is disposed on an adjacent weight 670. Female dovetail connector 650 includes a semi-circular female dovetail recess 678 having an open end on the lower surface. The open end is configured to slidably receive the male dovetail connector 680 on the adjacent weight 670. The dovetail joint formed between female connector 650 and male dovetail connector 680 of weight 670 prevents outer case 648 (along with the entire shell assembly 640) from rotating about axis B with respect to the attached weight 670. The dovetail joint also prevents the attached weight 670 from moving upward with respect to outer case 648 (and the entire shell assembly 640). The dovetail joint does not prevent the attached weight 670 from moving downward along axis A with respect to shell assembly 640—such downward translation is only prevented when one of the telescopic shafts 644 is positioned within an opening 682 formed in the attached weight 670. More particularly, when the telescopic shafts 644 is positioned within the opening 682 formed in the attached weight 670, the attached weight 670 is prevented from detaching from shell assembly 640 in the vertical direction due to the inter-engagement between the shaft 644, the central hole in the outer case 648, and opening 682 in the attached weight 670. The attached weight 670 is prevented from detaching from shell assembly 640 in the horizontal direction due to the inter-engagement between female dovetail connector 650 and male dovetail connector 680.

Figure 6A:
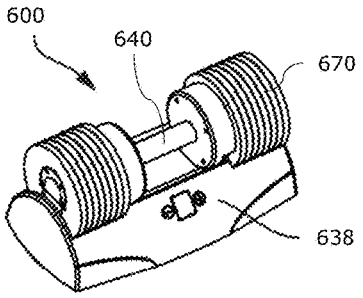
Figure 6B:
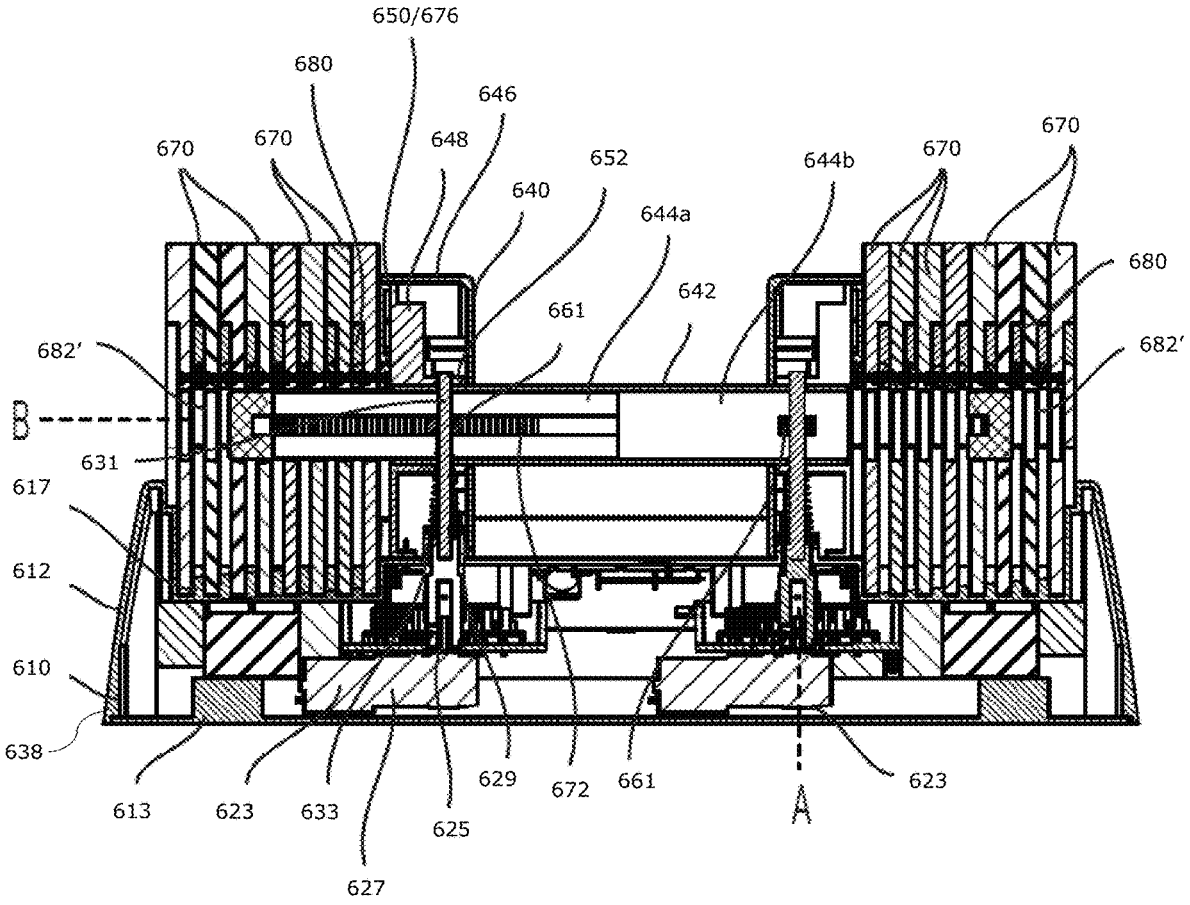
Figure 6C:
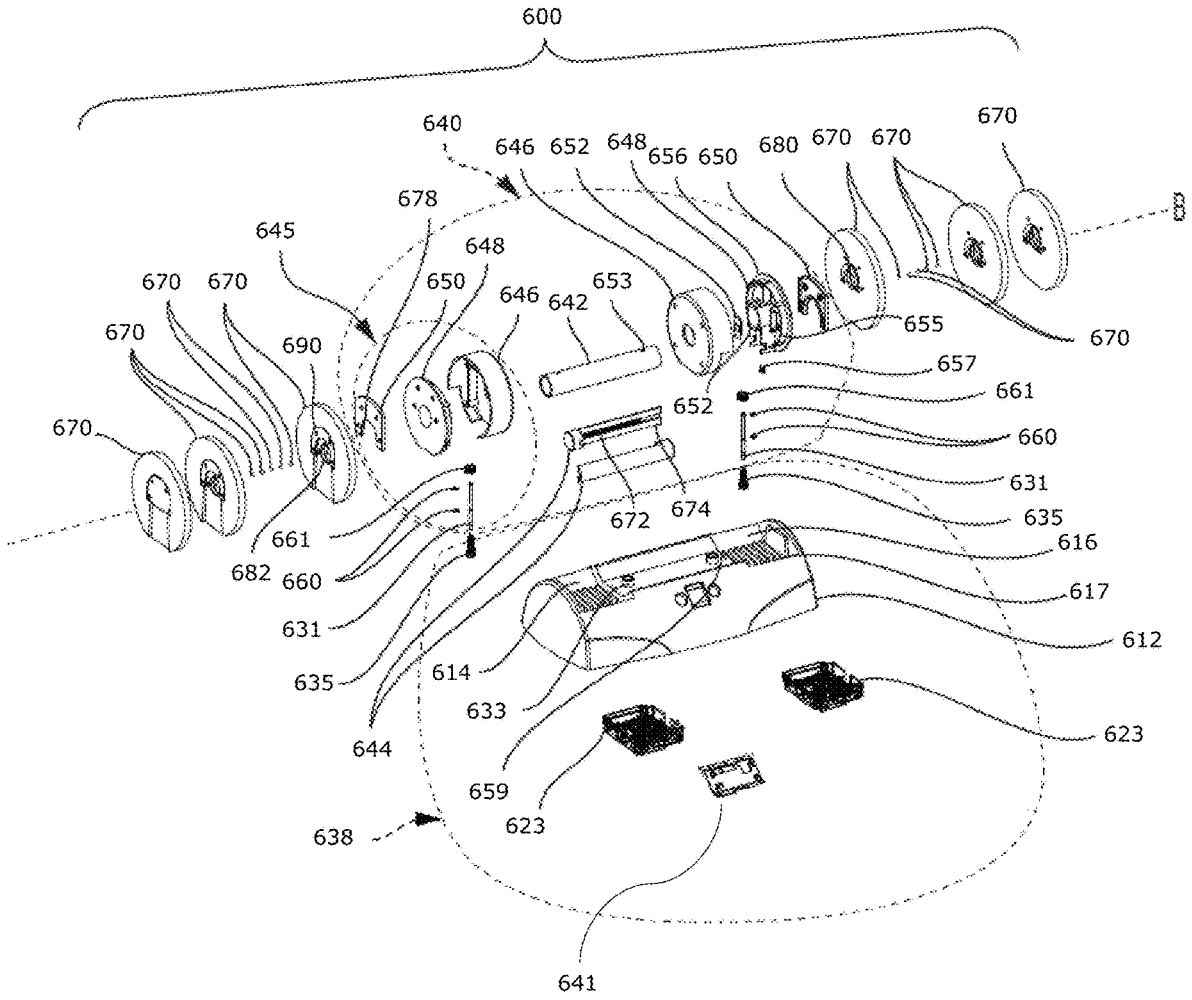
Figure 6D:
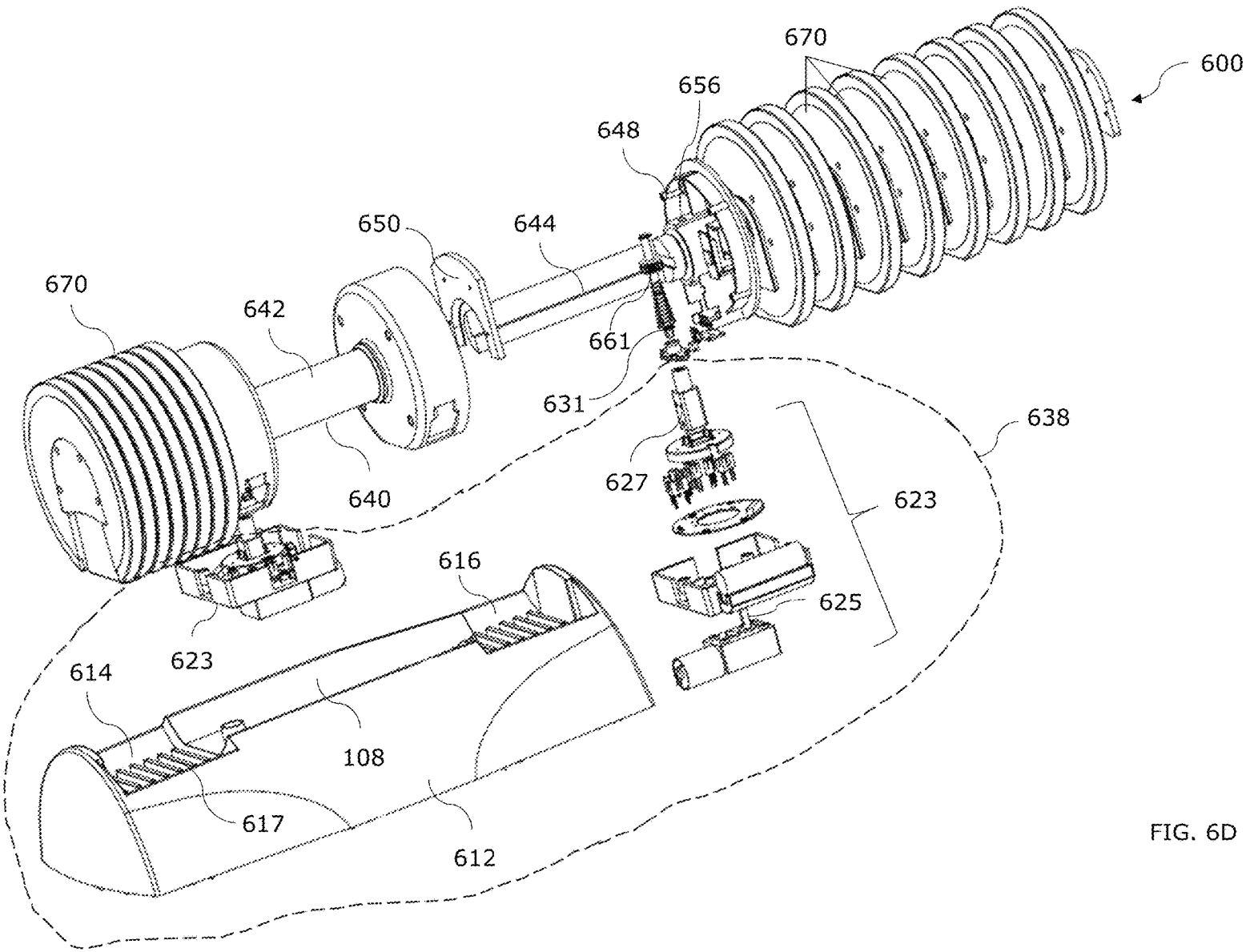
Figure 6E:
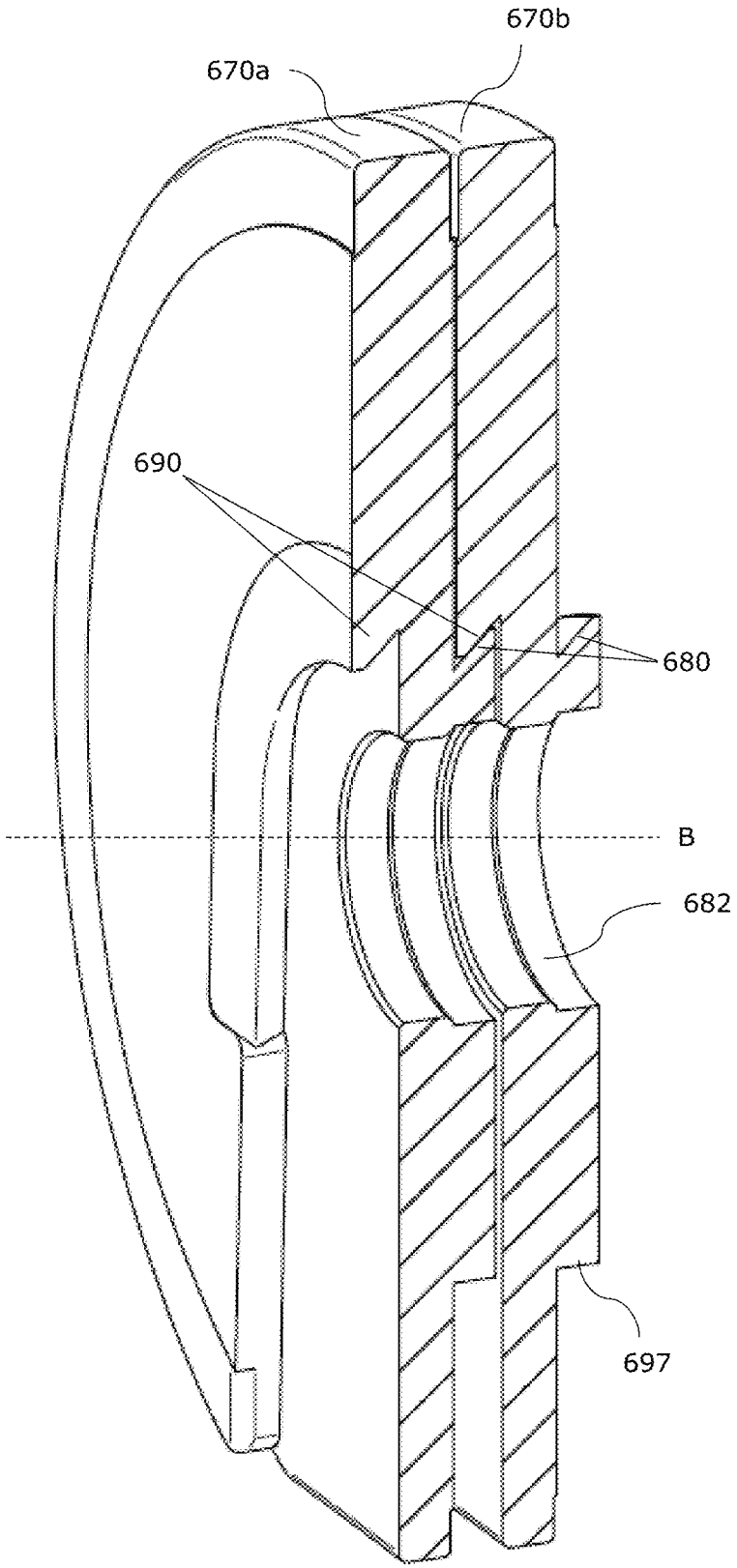

FIG. 6E depicts two weights 670*a* and 670*b* mated together. Each weight 670 includes a female dovetail connector 690 formed on one side of the weight 670, and male dovetail connector 680 formed on the opposing side thereof. The dovetail joint formed between female dovetail connector 690 and male dovetail connector 680 of two mated weights 670 prevents those mated weights from rotating about axis B with respect to each other. The dovetail joint also prevents attached weight 670*a* from moving upward along axis A with respect to the other attached weight 670*b*. The dovetail joint does not prevent the attached weight 670*a* from moving downward or the attached weight 670*b* from moving upward—such translation is only prevented when one of the telescopic shafts 644 is positioned within openings 682 formed in the weights 670*a* and 670*b*. The stack of aligned openings 682 together form an aperture 682' through which the shaft 644 can travel. More particularly, when the telescopic shaft 644 is positioned within the openings 682 formed in the attached weights 670*a* and 670*b*, the attached weights 670*a* and 670*b* are prevented from detaching from each other. Stated differently, the dovetail joint provides one degree of freedom for two weights 670 that are mated together, and that one degree of freedom is eliminated once telescopic shaft 644 is positioned within the openings 682 in those weights.

Operation of dumbbell 600 will now be described. In an assembled and docked state of dumbbell 600, weights 670 are nested together and positioned on housing 612. In the nested state, all of the weights 670 are interconnected together such that the weights 670 are prevented from rotating relative to one another by the mating geometries of male dove connectors 680 and female dove connectors 690. In the docked state of dumbbell 600, shell assembly 640 is docked on housing 612, and the spring pins 657 on shell assembly 640 are positioned in direct physical contact with electrical contacts 659 on the top surface of housing 612. Power and signals are passed between spring pins 657 and electrical contacts 659. More particularly, signals corresponding to readings of sensor 662 are transmitted from the PCB of shell assembly 640 to spring pins 657, to electrical contacts 659 and to PCB 641 of housing 612 such that the readings of sensor 662 are uploaded to the memory of system 10 or other system. Also, power is transmitted from system 10 to PCB 641 (via mating electrical contacts) then to electrical contacts 659 then to spring pins 657 then to the PCB of shell assembly 640 and then to the rechargeable battery of shell assembly 640 for recharging the rechargeable battery. The rechargeable battery provides power to the sensor 662 of shell assembly 640 as well as any other components of shell assembly 640 requiring power. As a result of the interconnection between the spring pins 657 and electrical contacts 659, the PCB 641 of housing 612 understands that shell assembly 640 is docked on housing 612.

Before dumbbell 600 is used, a user first selects the amount of desired weight for a particular exercise routine using dumbbell 600 by way of (i) computing device 110 of system 10, (ii) input features (such as buttons or a display) on dumbbell 600, or (iii) other system. This step is performed while shell assembly 640 is docked on housing 612. Adjusting the desired weight causes motors 623 to activate and rotate their output shafts 625 in the same direction. Rotating output shafts 625 causes rotation of shafts 631 and their toothed gears 661. Toothed gears 661 rotate about their axes in the same direction, which causes telescopic shafts 644 to either translate outwardly along axis B (i.e., away from handle 642) or translate inwardly along axis B (i.e., toward handle 642) due to the geared arrangement between toothed gears 661 and gear teeth 672 of telescopic shafts 644.

More particularly, if a user decreases the amount of weight than was previously used and displayed on computing device 110, then the gears 661 rotate in a direction to cause telescopic shafts 644 to translate inwardly and in opposite directions along axis B (i.e., toward handle 642). Telescopic shafts 644 move a discrete distance along axis B and disengage from the openings 682 in one or more weights 670. The distance travelled by shafts 644, which is caused by rotation of motors 623, is controlled by the processor on PCB 641. The distance travelled by shafts 644 is directly proportional to the weight selected by the user.

Once telescopic shafts 644 disengage from an opening 682 in a weight 670, then that weight 670 will detach from shell assembly 640 once shell assembly 640 is removed from housing 612. In other words, that weight 670 will remain docked on housing 612 once shell assembly 640 is removed from housing 612. For example, with reference to FIG. 6E, if a telescopic shaft 644 is initially engaged with both weights 670*a* and 670*b*, and the telescopic shaft 644 is translated such that it is no longer positioned within opening 682 of weight 670*a*, then when the user removes the shell assembly 640 from housing 612, weight 670*b* will be attached to shell assembly 640 while weight 670*a* will remain docked on housing 612. Stated differently, the dovetail joint is configured to permit adjacent weights to become detached when a shaft 644 is not positioned within an opening 682 in one of those weights.

The user then removes shell assembly 640 along with weights 670 attached thereto and performs an exercise routine. Once electrical contacts 659 of housing 612 become detached from spring contacts 657 of shell assembly 640, the processor knows that shell assembly 640 has been removed from housing 612 and an exercise routine is underway.

Alternatively, if a user increases the amount of weight than was previously used, then the gears 661 rotate to cause telescopic shafts 644 to translate outwardly along axis B (i.e., away from handle 642). Telescopic shafts 644 move a discrete distance along axis B and engage with the openings 682 in one or more additional weights 670. The distance travelled by shafts 644, which is caused by rotation of motors 623, is controlled by the processor on PCB 641. The distance travelled by shafts 644 is directly proportional to the weight selected by the user. Once telescopic shafts 644 engage an opening 682 in a weight 670, then that weight 670 cannot be detached from shell assembly 640 once shell assembly 640 is removed from housing 612. The user then removes shell assembly 640 along with weights 670 attached thereto and performs an exercise routine.

Following the exercise routine, the user returns the shell assembly 640 to housing 612 (i.e., docks shell assembly 640). Upon returning the shell assembly 640 to base housing 612, the lower end of each shaft 631 on shell assembly 640 engages in a respective opening 629 on intermediate shaft 627 of housing 612. Spring contacts 657 then physically engage electrical contacts 659 on housing 612.

Exercise data may be transmitted real-time during the exercise routine to system 10 via wireless transmission. Alternatively, once the shell assembly 640 is docked on housing 612, data can be transmitted from the PCB of the shell assembly 640 to PCB 641 due to the interconnection of contacts 657 and 659, and that data can thereafter be transmitted to system 10. The system 10 may contain a program that is configured to track the data for each exercise routine.

The exercise data contains information related to the amount of weight used in an exercise routine, the number of curls, reps or motions in the exercise routine (as measured by accelerometer of shell assembly 640) and the time duration of the exercise routine, for example.

Further details of dumbbells 600 are disclosed in U.S. Pat. No. 10,463,906, which is incorporated by reference herein in its entirety and for all purposes.

Turning now to FIGS. 7-12, examples of systems and methods for monitoring and/or assessing physical fitness of a user from disparate exercise devices and activity trackers using the system 10 are illustrated. The systems and methods can include exercise devices such as, for example, one or more exercise devices or apparatuses 200, 300, 500, 600 and 2100. Although reference is made in various examples to systems and methods employing exercise device 300, it is contemplated that exercise device 200, 500, 600, 2100 or any other exercise device is optionally additionally or alternatively included in the systems or methods that are described hereinafter.

FIG. 7 is a high-level functional block diagram of an example physical fitness assessment system 1900 including the exercise device 300 having a movement tracker 1918 to identify current physical activity based on exercise device programming 1945 (which includes, for example, a neural network model), the computing device 110, and a server system 1998 connected via various networks. Exercise device 300 is connected with a host computer of the computing device 110 via the high-speed wireless connection 1937 or connected to the server system 1998 via the network 1995.

In this example, the host computer is incorporated in computing device 110, however, in other examples, the host computer may be an activity tracker 2010. The activity tracker 2010 may be a smart phone or wearable watch device, for example.

Physical fitness assessment system 1900 includes at least one exercise device 300 (it is noted that the exercise device could be the dumbbell, pushup bar or any other exercise device) in the example of FIG. 7.

Exercise device 300 includes the movement tracker 1918 and an optional image display 1980. Exercise device 300 also includes or is otherwise directly or indirectly associated with an image display driver 1942, image processor 1912, and a micro-control unit (MCU) 1930. Image display 1980 is configured for presenting images and videos, which can include a sequence of images. Image display driver 1942 is coupled to the image display 1980 to present the images. The components shown in FIGS. 7-9 for the exercise device 300 are located on one or more circuit boards, for example a PCB or flexible PCB.

Movement (movt) tracker 1918 is an electronic device, such as an inertial measurement unit (IMU), that measures and reports for example a body's specific force, angular rate, and sometimes the magnetic field surrounding the body, using a combination of accelerometers and gyroscopes, sometimes also magnetometers. For example, an accelerometer can be included in a kettlebell or dumbbell. A neural network model can be used to track the number of repetitions, number of sets, or other manipulations made to or sensed by the exercise device. Such accelerometer measurements can be processed on device 300 or a separate computing device (e.g. computing device 110) to track the number of repetitions, number of sets, or other manipulations if the exercise device (e.g., kettlebell and/or dumbbell) itself tracks the manipulations.

If a magnetometer is present, the magnetic field can be used as input to detect specific physical activities (e.g., weightlifting—number of repetitions, number of sets, etc.) that are dependent on Earth's or an artificial magnetic field. In this example, the inertial measurement unit determines a rotation acceleration of the exercise device 300. The movement tracker 1918 works by detecting linear acceleration using one or more accelerometers and/or rotational rate using one or more gyroscopes. The inertial measurement units can contain one accelerometer, gyroscope, and magnetometer per axis for each of the three axes: horizontal axis for left-right movement (X), vertical axis (Y) for top-bottom movement, and depth or distance axis for up-down movement (Z). The gyroscope detects the rate of rotation around 3 axes (X, Y, and Z). The magnetometer detects the magnetic field (e.g., facing South, North, etc.) like a compass which generates a heading reference, which is a mixture of Earth's magnetic field and other artificial magnetic field (such as ones generated by power lines). The three accelerometers detect acceleration along the horizontal (X), vertical (Y), and depth or distance (Z) axes defined above, which can be defined relative to the ground, the exercise device 300, or the user moving the exercise device 300. Thus, the accelerometer detects a 3 axis acceleration vector, which then can be used to detect Earth's gravity vector.

Generally, the neural network is pre-trained with a labeled data set, then on the exercise device 300, the neural network is executed through a forward-pass mechanism where the inputs (model input layer 1959A-N) is presented and the trained weights are used to calculate the outputs (model output layer 1968A-N). The outputs represent the probabilities of each set and repetitions to be tracked when the exercise device 300 is lifted by the user.

In the physical fitness assessment system 1900, exercise device 300 includes the model input layer 1959A-N, which is tracked movement over time period 1960 for the exercise device 300. Tracked movement over time period 1960 includes accelerometer measurements 1961A-N, which includes measured acceleration (MA) 1962A-N and measured acceleration time coordinates 1963A-N to indicate when the measured acceleration 1962A-N was taken. Tracked movement over time period 1960 further includes gyroscope measurements 1964A-N, which includes measured rotation (MR) 1965A-N, measured rotation time coordinates 1966A-N to indicate when the measured rotation 1965A-N was taken, and motion interrupt time coordinates 1967A-N (e.g., times when motion is detected).

As shown, memory 1934 further includes exercise device programming 1945 to perform a subset or all of the functions described herein for the exercise device 300. Although the neural network model can include an input layer, hidden layers and output layer, in the example the neural network model of the exercise device programming 1945 includes convolutional layers (several), fully connected layers (these used to be hidden layers) and a single output layer. Exercise device programming 1945 has a trained exercise device model (e.g., shown as weightlifting model 1946), a set of weights 1947A-N, and hidden layers 1948. Memory 1934 further includes a model output layer 1968A-N. Model output layer 1968A-N has an identified number of sets 1969A-N, an identified number of repetitions 1970A-N, set confidence levels 1971A-N for the identified number of sets 1969A-N, and repetition confidence levels 1972A-N for the identified number of repetitions 1970A-N per set.

In one example, the inputs—model input layer 1959A-N, such as the tracked movement over time period 1960 measurements taken by the movement tracker 1918, may be transmitted to the computing device 110 (and/or a wearable device 2010) from the exercise device 300. The computing device 110 (and/or the wearable device 2010) include the trained exercise device model (e.g., shown as weightlifting model 1946), the set of weights 1947A-N, and the hidden layers 1948. Computing device 110 or the wearable device 2010 can then calculate the outputs (model output layer 1968A-N) from the inputs to determine the current physical activity data 1975A.

MCU 1930 includes processor 1932, memory 1934, and high-speed wireless circuitry 1936. In the example, the image display driver 1942 is coupled to the high-speed circuitry 1930 and operated by the high-speed processor 1932 in order to drive the image display 1980. Processor 1932 may be any processor capable of managing high-speed communications, low-speed communications, and operation of any general computing system needed for exercise device 300. Processor 1932 includes processing resources needed for managing high-speed data transfers on high-speed wireless connection 1937 to/from a wireless local area network (WLAN) using high-speed wireless circuitry 1936. In certain embodiments, the processor 1932 executes firmware that includes the exercise device programming 1945 and an operating system, such as a LINUX operating system or other such operating system of the exercise device 300 and the operating system is stored in memory 1934 for execution. In addition to any other responsibilities, the processor 1932 executing a software architecture for the exercise device 300 is used to manage data transfers with high-speed wireless circuitry 1936 (network communication interface or transceiver). In certain embodiments, high-speed wireless circuitry 1936 is configured to implement Institute of Electrical and Electronic Engineers (IEEE) 802.11 communication standards, also referred to herein as Wi-Fi. In other embodiments, other high-speed communications standards may be implemented by high-speed wireless circuitry 1936.

MCU 1930 may communicate with controller 322 to activate and deactivate driver 320 of device 300. MCU 1930 is configured to receive instructions from computing device 110 for changing and/or monitoring the number of weights 370 on device 300 using driver 320, as described above. Controller 322 may be incorporated into MCU 1930, and interact with processor 1932.

Low-power wireless circuitry 1924 (network communication interface or transceiver) and the high-speed wireless circuitry 1936 of the exercise device 300 can include short range transceivers (Bluetooth™) and wireless wide, local, or wide area network transceivers (e.g., cellular or WiFi). Computing device 110, including the transceivers communicating via the low-power wireless connection 1925 and high-speed wireless connection 1937, may be implemented using details of the architecture of the exercise device 300, as can other elements of network 1995. Although not described in great detail herein, the other exercise devices (e.g., devices 200 and 600) described herein can communicate with computing device 100 in the same fashion.

Computing device 110 may be fixedly mounted to system 10, as described above, or computing device 110 may be a tablet, access point, or any other such device capable of connecting with exercise device 300 using both a low-power wireless connection 1925 and a high-speed wireless connection 1937. Computing device 110 is connected to server system 1998 and network 1995. The network 1995 may include any combination of wired and wireless connections.

Physical fitness assessment system 1900 (optionally) includes an activity tracker 2010 (e.g., a wearable device or a smart phone). The activity tracker 2010 can be a watch as shown in FIG. 8, wristband, or other portable device designed to be held, worn by or associated with a user to communicate via one or more wireless networks or wireless links with computing device 110 or server system 1998.

Memory 1934 includes any storage device capable of storing various data and applications, including, among other things, model input layer 1959A-N, exercise device programming 1945, model output layer 1968A-N, selections of an amount of weight to lift 1973A-N from the user, various time durations 1974A-N, as well as images and videos generated for display by the image display driver 1942 on the image display 1980. While memory 1934 is shown as integrated with MCU 1930, in other embodiments, memory 1934 may be an independent standalone element of the exercise device 300. In certain such embodiments, electrical routing lines may provide a connection through a chip that includes the processor 1932. In other embodiments, the processor 1932 may manage addressing of memory 1934 any time that a read or write operation involving memory 1934 is needed.

As shown in FIG. 7, the exercise device 300 includes an exercise device network communication interface 1924, 1936 for communication over a network 1925, 1937. Exercise device 300 further includes a movement tracker 1918 configured to track movement of the exercise device 300, an exercise device memory 1934, and an exercise device processor 1932. The exercise device processor 1932 is coupled to the exercise device network communication interface 1924, 1936, the movement tracker 1918, and the exercise device memory 1934. The exercise device 300 includes exercise device programming 1945 in the exercise device memory 1934. In addition or in the alternative, the computing device 110 of system 10 may also include exercise device programming 1945 in the device memory.

Exercise device 300 can perform all or a subset of any of the following functions described below as a result of the execution of the exercise device programming 1945 in the memory 1934 by the processor 1932 of the exercise device 300. Computing device 110 can perform all or a subset of any of the following functions described below as a result of the execution of the physical fitness assessment programming 2140 in the memory 2240A by the processor 2230 of the computing device 110.

Execution of the exercise device programming 1945 by the processor 1932 configures the exercise device 300 to perform functions, including functions to track via the movement tracker 1918, movement of the exercise device 300 by a user. Exercise device 300 determines a current physical activity data 1975A of the user based on, at least, the tracked movement over a time period 1960 of the exercise device 300 by the user. Exercise device 300 transmits over the network 1925, 1937 via the exercise device network communication interface 1924, 1936 the current physical activity data 1975A.

Processor 2230 may be generally referred to herein as a system processor.

In the example of FIG. 7, the exercise device 300 can be a weight machine or a free-weight training equipment or other form of exercise or fitness equipment. As shown in FIG. 7, movement tracker 1918 includes: (i) at least one accelerometer 1920 to measure acceleration of the exercise device 300, (ii) at least one gyroscope 1921 to measure rotation of the exercise device 300, or (iii) an inertial measurement unit (IMU) 1919 having the at least one accelerometer 1920 and the at least one gyroscope 1921. The function of tracking, via the movement tracker 1918, the movement of the exercise device 300 includes: (i) measuring, via the at least one accelerometer 1920, the acceleration of the exercise device 300, (ii) measuring, via the at least one gyroscope 1921, the rotation or rotational movement of the exercise device 300, or (iii) measuring, via the inertial measurement unit 1919, both the acceleration and the rotation or rotational movement of the exercise device 300.

In one example, if the exercise device 300 is free-weight training equipment, then the free-weight training equipment is a dumbbell, a kettlebell, or a barbell. The current physical activity data 1975A includes a number of sets 1969A-N and a number of repetitions 1970A-N determined based on the tracked movement over the time period 1960 of the exercise device 300 by the user. Here, the notation A-N corresponds to each segment in which the physical activity is divided. In the example of weightlifting, for example, the segment is a weightlifting set, where each weightlifting set is separated based on a spike in physical activity followed by significant drop as measured by the movement tracker 1918 or a clock as passage of elapsed time (e.g., 60 or 90 second breaks in between sets).

As noted above, the free-weight training equipment type of exercise device 300 includes an exercise device user input device to receive from the user a selection of an amount of weight to lift 1973A-N. Alternatively, the exercise device 300 may receive the weight selection from the computing device 110. The exercise device 300 can further include a clock to track a time duration 1974A-N. Execution of the exercise device programming 1945 further configures the exercise device to perform functions to receive, via the exercise device user input device of the device 300 or the computing device 110, from the user the selection of the amount of weight 1973A-N to lift. Exercise device 300 tracks, via the clock, a respective time duration 1974A-N of each set of the number of sets 1969A-N. The current physical activity data 1975A includes the selection of the amount of weight to lift 1973A-N and the respective time duration 1974A-N of each set 1969A-N.

Output components of the exercise devices 300 and 2100, computing device 110, and wearable device 2010 optionally include visual components, such as the image display 1980, 2280, 2380 (e.g., a display such as a liquid crystal display (LCD), a plasma display panel (PDP), a light emitting diode (LED) display, a projector, or a waveguide). Image displays 1980, 2280, 2380 can present images, such as in a video. The image displays 1980, 2280 are driven by the image display driver 1942, 2290, 2390. The output components of the exercise device 300, computing device 110, and wearable device 2010 can further include acoustic components (e.g., speakers), haptic components (e.g., a vibratory motor), other signal generators, and so forth. The input components (user input devices 124, 2291, 2391) of the exercise device 300, the computing device 110, activity tracker 2010, and server system 1998, may include alphanumeric input components (e.g., a keyboard, a touch screen configured to receive alphanumeric input, a photo-optical keyboard, or other alphanumeric input components), point-based input components (e.g., a computer mouse, a touchpad, a trackball, a joystick, a motion sensor, or other pointing instruments), tactile input components (e.g., a physical button, a touch screen that provides location and force of touches or touch gestures, or other tactile input components), audio input components (e.g., a microphone), and the like.

Exercise devices 300 and 2100, computing device 110, activity tracker 2010 (e.g., wearable device), and server system 1998 may optionally include additional peripheral device elements. Such peripheral device elements may include biometric sensors, additional sensors, or display elements integrated. For example, peripheral device elements may include any I/O components including output components, motion components, position components, or any other such elements described herein.

For example, the biometric components of the exercise devices 300 and 2100, computing device 110, and activity tracker 2010 (e.g., wearable device) include components to detect expressions (e.g., hand expressions, facial expressions, vocal expressions, body gestures, or eye tracking), measure biosignals (e.g., blood pressure, heart rate, body temperature, breathing/respiration rate, perspiration, or brain waves), identify a person (e.g., voice identification, retinal identification, facial identification, fingerprint identification, or electroencephalogram based identification), and the like.

The motion components include acceleration sensor components (e.g., accelerometer), gravitation sensor components, rotation sensor components (e.g., gyroscope), and so forth. The position components include location sensor components to generate location coordinates (e.g., a Global Positioning System (GPS) receiver component), WiFi or Bluetooth™ transceivers to generate positioning system coordinates, altitude sensor components (e.g., altimeters or barometers that detect air pressure from which altitude may be derived), orientation sensor components (e.g., magnetometers), and the like. Such positioning system coordinates can also be received over wireless connections 1925 and 1937 from the computing device 110 via the low-power wireless circuitry 1924 or high-speed wireless circuitry 1936.

Power distribution circuitry distributes power and ground voltages to the MCU 1930 from the power supply, wireless transceivers 1924, 1936, and other components to provide reliable operation of the various circuitry on the chip. Power supply 1130 is driven by a power source. Power supply 1130 receives power from the power source, such as an AC mains of the system 10, battery, solar panel, or any other AC or DC source. Power supply 1130 may include a magnetic transformer, electronic transformer, switching converter, rectifier, or any other similar type of circuit to convert an input power signal into a power signal suitable for exercise device 300.

FIG. 8 shows an example of a hardware configuration for the server system 1998 of FIG. 7, for example, to build a neural network model for the exercise device, in simplified block diagram form. The activity tracker 2010 (e.g., wearable device) can be connected to the computing device 110 via low-power wireless connection 1925E. Server system 1998 may be one or more computing devices as part of a service or network computing system, for example, that include a memory 2050, a processor 2060, a network communication interface 2061 to communicate over the network 1995 with the computing device 110, the exercise device 300, and the activity tracker 2010, such as a smartwatch. The memory 2050 includes weightlifting training data (TD) 2076A-N, which includes tracked movement over time intervals for known sets and repetitions 2077A-N. Weightlifting training data 2076A-N includes accelerometer training data (TD) 2078A-N. Accelerometer training data 2078A-N has acceleration measurements 2079A-N and acceleration time coordinates 2080A-N to indicate when the acceleration measurement 2079A-N was taken. Weightlifting training data 2076A-N includes gyroscope training data 2081A-N. Gyroscope training data 2081A-N has rotation measurements 2082A-N and rotation time coordinates 2083A-N to indicate when the rotation measurement 2082A-N was taken. Weightlifting training data 2076A-N also includes motion interrupt time coordinates 2084A-N (e.g., times when motion is detected).

Memory 2050 also includes an exercise device model generator, shown as exercise device neural network programming 2075. Memory 2050 also includes trained weightlifting model 1946 which is outputted in response to applying the exercise device neural network programming 2075 to the inputted weightlifting training data 2076A-N. As shown, the output of the exercise device neural network programming 2075 includes a set of weights 1947A-N, and hidden layers 1948, such as repetition and set events 1949A-N. The trained weightlifting model 1946, set of weights 1947A-N, and hidden layers 1948 are loaded in the exercise device 300 for repetition and set detection. Alternatively, the exercise device model—trained weightlifting model 1946, set of weights 1947A-N, and hidden layers 1948 can be loaded in the computing device 110 and the computing device 110 may receive the model input layer 1959A-N (e.g., tracked movement over time period 1960) from the exercise device via wireless connections 1925, 1937. The exercise device model, such as the trained weightlifting model 1946, may then be executed on the computing device 110.

Execution of the exercise device neural network programming 2075 by the processor 2060 configures the server system 1998 to perform some or all of the functions described herein before execution of the exercise device model (e.g., the trained weightlifting model 1946) by the processor 1932 of the exercise device 300. First, acquire the exercise device (e.g., weightlifting training data 1976A-N) of: (i) acceleration 1978A-N, (ii) rotation 1981A-N, or (iii) both the acceleration 1978A-N and the rotation 1981A-N of the exercise device 300 over one or more time intervals for the known sets and repetitions 1977A-N. Second, build the trained exercise device model (e.g., trained weightlifting model 1946) to identify physical activity data (e.g., sets and repetitions) correlated with the exercise device 300 based on the acquired training data 1976A-N. The function to build the exercise device model (e.g., the trained weightlifting model 1946) includes functions to calibrate the set of weights 1947A-N from the acquired training data 1976A-N of the physical activity; and store the calibrated set of weights 1947A-N in the exercise device model (e.g., the trained weightlifting model 1946) in association with the physical activity data.

FIG. 9 is a high-level functional block diagram of the example physical fitness assessment system 1900 including multiple exercise devices 300, 600, 2100, the computing device 110, the activity tracker 2010 (e.g., wearable device), and the server system 1998 connected via various networks 1925A-D, 1995, 2109. Exercise devices 300, 600, 2100 provide fixed or adjustable amounts of resistance, or to otherwise enhance the experience or outcome of an exercise routine. In the fitness assessment system 1900, disparate types of exercise devices can be utilized, for example, the exercise devices 2100 can include a treadmill, an exercise bike, a stair machine, or an elliptical machine. Depending on the type of exercise device 2100, the movement tracker 1918 can vary, for example, the movement tracker 1918 can include a tachometer (e.g., to measure revolutions per minute of a belt of a treadmill or an exercise bike). If the length of the treadmill belt is known, distance travelled can be measured; and speed can be readily determined from the distance travelled determined using a clock to track time duration. If the exercise device 2100 is a rowing machine or a hand grip, then the movement tracker 1918 may be an ergometer or a dynamometer.

As shown, the exercise devices include a kettlebell 300, dumbbell 600, treadmill 2100A, and exercise bike 2100B. The exercise devices and the activity tracker 2010 can connect via respective low-power wireless connections 1925A-D (short-range) to the computing device 110; however, respective high-speed wireless connections 1937A-E (e.g., WiFi) can be implemented over the wireless communication network 2109 by accessing the wireless access point 2108. If high-speed wireless connections 1937A-E are implemented in the exercise devices and the activity tracker 2010, then the server system 1998 can be directly accessed without the computing device 110. However, in the depiction of FIG. 9, the exercise devices and the activity tracker 2010 can access the server system 1998 through the computing device 110 because the computing device 110 has a high-speed wireless connection 2137 (e.g., WiFi) to the wireless communication network 2109. The wireless communication network 2109 is connected to the network 1995 via a network link 2135.

As shown, the server system 1998 includes the memory 2050 and the memory includes physical fitness assessment server programming 2150. Physical fitness assessment server programming 2150 is the back-end server programming of the physical fitness assessment system 1900. Memory 2050 further includes multiple user profiles 2155A-N for many different users of the physical fitness assessment system 2155A-N. Memory 2050 further includes benchmark physical activity data 2160A-N for many different types of exercise devices 2100 and activity trackers 2010 for comparison purposes.

Exercise system 1900 can perform all or a subset of any of the functions described herein as a result of the execution of the exercise device programming 1945 in the memory 1934 by the processor 1932 of the exercise device 300. Computing device 110 can perform all or a subset of any of the functions described herein as a result of the execution of the physical fitness programming 2140 in the memory 2240A by the processor 2230 of the computing device 110. Server system 1998 can perform all or a subset of any of the functions described herein as a result of the execution of the physical fitness server programming 2150 in the memory 2050 by the processor 2060 of the server system 1998. Functions can be divided in the physical fitness assessment system 1900, such that the host computer functions are divided up differently between the computing device 110 and the server system 1998 or combined to entirely occur in the computing device 110, entirely in the server system 1998, a mobile device (such as a smart phone) or even a wearable device like the smartwatch shown for the activity tracker 2010. Moreover, some of the functions attributed to the computing device 110 may occur in the exercise devices 2100 or activity tracker 2010.

The physical fitness assessment 2261 is based on activity input from multiple exercise devices 300, 600, 2100 (which track respective current physical activity data 1975A-D) and activity tracker 2010, which can be measured against the benchmark physical activity data 2160A-N that can stores guidelines from the American College of Sports Medicine. The benchmark physical activity data 2160A-N provide guidelines for specific categories of people that can be based on user profiles 2155A-N, for example, based on demographics (age, gender, race, etc.), height and weight, for example. In addition, the benchmark physical activity data 2160A-N can measured against a benchmark setting level 2281 (such as an activity level) that is set by the user, such as beginner, intermediate, or elite (target physical activity fitness level to achieve) and can account for the differences between the average person vs. athletes.

The greater the amount of current physical activity data 1975A and supplemental physical activity data 2375A and user profile settings 2256A-E for the user, the more accurate the physical fitness assessment 2261. Computing device 110 includes respective current physical activity data 1975A transmitted from the exercise device 300 of FIG. 7 (further shown as exercise device 300 in FIG. 7), as well as respective current physical activity data 1975B-D transmitted from respective exercise devices of FIG. 9. The physical fitness assessment 2261 can be based on a daily, monthly, or yearly basis and can be cumulative over time. The physical fitness assessment 2261 is displayed via the image display 2280 as the physical fitness assessment image 2262. For example, an indicator bar increases when current repetitions times weight approaches or exceeds that from a previous workout.

Benchmark physical activity 2160A-N can be personalized based on the user profile settings 2256A-E. For example, user profile settings 2256A-E can be evaluated to determine a health risk profile of the user. Race 2256E can, for example, be a significant risk factor in contributing to conditions, such as diabetes for example, and may optionally be weighed more heavily in evaluating the health risk profile of the user. If the health risk profile of the user is high for any particular condition, the benchmark physical activity data 2160A-N may be adjusted to require extra or otherwise modified physical activity to compensate for the risk profile of the user. For exercise devices 300 and 600 (kettlebell and dumbbell), for example, a greater number of sets 1969A-N and number of repetitions 1970A-N can be set. For exercise device 2100 (treadmill) and exercise device 2100 (bike), a greater or otherwise modified exercise time duration and distance traveled can be set. For activity tracker 2010, a greater or otherwise modified number of steps 2378A-N, distance traveled 2405A-N, calories burned 2406A-N, time duration 2377A-N, and heart rate 2376A-N can be set.

The physical fitness assessment 2261 can provide an overall indicator to the user of their physical fitness and track preset goal, for example, in a physical fitness image 2262 (which may be referred to as a Fitness IQ) that is presented on the image display 2280 as a dashboard. Preset goals, can be stored in the user profile 2155A as target physical activity data 2160A. The physical fitness assessment 2261 can track the preset goals which can vary depending on the type of exercise device 300, 600, 2100. For exercise devices (e.g., kettlebell 300 or dumbbell 600), preset goals can include daily or weekly number of repetitions, daily or weekly number of sets, or daily or weekly amount of weight. For activity tracker 2010 or exercise device 2100A (treadmill), preset goals can include daily steps; and minutes or hours of daily sleep for just the activity tracker 2010. Computing device 110 may be programmed to automatically adjust the weight on the exercise devices based upon the preset goals. Goals may be preset as described above or form part of a generic computer program.

As shown in FIG. 12, for a smart scale device 2410, the physical fitness assessment 2261 can track body weight 2411, body fat 2412, body water 2413, muscle mass 2414, body mass index (BMI) 2415, basal metabolic rate 2416 (BMR—e.g., in kilocalories), bone mass 2417, and visceral fat 2418. The physical fitness assessment 2261 can track number of steps, distance, calories, time duration, and heart rate from an activity tracker 2010 or exercise device 2100A (treadmill), as well as distance, calories, time duration, and heart rate from other cardiovascular exercise devices, such as exercise device 2100B (exercise bike). These metrics can be displayed in the physical fitness assessment image 2261 as a percentage of a goal or communication via audio (aural) over a speaker, etc. For the exercise device 300 (kettlebell), time duration can be displayed towards an overall workout.

FIG. 10 shows an example of a hardware configuration for the computing device 110 of the physical fitness assessment system 1900 of FIGS. 7-9. As shown in FIG. 10, the computing device 110 is a host computer that connects to the exercise devices 300, 600, 2100, and activity tracker 2010. As shown, the computing device 110 includes an image display 2280 for presenting a physical fitness assessment image 2262 based on the tracked current physical activity data 1975A of the user. The image display 2280 may be a touch screen, remote controlled or voice controlled, as noted previously. The computing device 110 includes an image display driver 2290 coupled to the image display 2280 to control the image display 2280 to present the physical fitness assessment image 2262.

The computing device 110 includes a user input device 2291 to receive from the user a physical fitness assessment selection 2140 to apply to the current physical activity data 1975A to generate the physical fitness assessment image 2262. The computing device 110 includes a network communication interface for communication over the network, a host computer memory 2240A-B, and a processor 2230 coupled to the image display driver 2290, the user input device 2291, and the network communication interface (short range transceivers 2220 and wireless area network transceivers 2210). Network communication interface (short range transceivers 2220 and wireless area network transceivers 2210) may also be referred to herein as a system network communication interface. The computing device 110 includes host computer programming, shown as physical fitness assessment programming 2140 in the memory 2250A.

Transceivers 2220 and 2210 are configured to transmit data and instructions to and from the MCU 1930 of the exercise devices 300, 600 and/or (optionally) 2100 via the high-speed wireless circuitry 1936 for controlling those exercise devices. For example, as shown in FIG. 14, using the graphical user interface (GUI) of the computing device 110, a user can adjust the weight or resistance on the exercise devices 300, 600 remotely using icons 2600 and 2602 on the GUI. Alternatively, the computing device 110 can automatically adjust the weight or resistance on the exercise devices 300, 600 according to exercise device programming 1945 (or other program). GUI also includes icons for connecting the user to real-time exercise data (e.g., number of reps and weight), personal trainers, live and on-demand exercise classes and/or other users of similar systems 10.

Execution of the physical fitness assessment programming 2140 by the processor 2230 configures the computing device 110 to perform functions. Computing device 110 receives over the network 1925, 1937, via the network communication interface 2220, from the various exercise devices the tracked current physical activity data 1975A of the user. Computing device 110 receives, via the user input device 2291, the physical fitness assessment selection 2259 to apply to the current physical activity data 1975A. Computing device 110 compares the current physical activity data 1975A of the user against benchmark physical activity data, shown as target physical activity data 2160A and historic physical activity data 2160B, correlated with the exercise devices. Based on the comparison, computing device 110 determines a physical fitness assessment 2261 of the user. Computing device 110 generates the physical fitness assessment image 2262, based on the physical fitness assessment 2261 of the user. Computing device 110 presents, via the image display 2280, the physical fitness assessment image 2262.

In one example, execution of the physical fitness programming 2140 by the processor 2230 further configures the computing device 110 to perform functions to receive, via the user input device 2291, from the user a profile setting 2256A-E that includes an age 2256A, a gender 2256B, a height 2256C, a weight 2256D, or a race 2256E. Computing device 110 sets a user profile 2155A of the user stored in the memory 2240A in response to the received profile setting 2256A-E. Computing device 110 receives, via the user input device 2291, from the user a benchmark setting level 2281 (beginner, intermediate, or elite—target physical activity fitness level to achieve). Computing device 110 adjusts the benchmark physical activity data to a target physical activity data 2160A based on the user profile setting 2256A-E and the received benchmark setting level 2281.

Execution of the physical fitness programming 2140 by the processor 2230 further configures the computing device 110 to perform functions to receive, via the user input device 2291, from the user a date range 2263 of a historic physical activity data 2160B of the user during which a previous physical activity data of the user was tracked. Computing device 110 adjusts the benchmark physical activity data based on the historic physical activity data 2160B of the user.

FIG. 11 shows an example of a hardware configuration for the activity tracker 2010 of the physical fitness assessment system 1900 of FIGS. 8 and 9. The physical fitness assessment system 1900 includes the activity tracker 2010 to monitor physical activity of the user. As shown, the activity tracker 2010 includes an activity tracker device network communication interface (e.g., short range XCVRs 2320 for communication over the network 1925E) for communication over the network 1995. Activity tracker 2010 includes a heart rate monitor 2325 configured track a heart rate 2376A-N of the user. Activity tracker 2010 further includes an activity tracker device memory 2340A, an activity tracker processor 2330 coupled to the activity tracker network communication interface 2320, the heart rate monitor 2325, and the activity tracker memory 2240A. Activity tracker 2010 further includes activity tracker programming 2315 in the activity tracker memory 2340A.

Execution of the activity tracker programming 2315 by the activity tracker processor 2330 configures the activity tracker 2010 to perform functions to track, via the heart rate monitor 2325, the heart rate 2376A-N of the user over a time duration 2377A-N. Activity tracker 2010 determines, a supplemental physical activity data 2375A of the user based on the monitored heart rate 2376A-N over the time duration 2377A-N. Activity tracker 2010 transmits over the network 1925E to the computing device 110, via the activity tracker network communication interface 2320, the supplemental physical activity data 2375A of the user.

Execution of the physical fitness programming 2140 by the processor 2230 further configures the computing device 110 to perform functions to receive over the network 1925E, via the network communication interface 2220, from the activity tracker 2010 the tracked supplemental physical activity data 2375A of the user. Computing device 110 compares the supplemental physical activity data 2375A of the user against correlated with the activity tracker 2010. The function of the determining the physical fitness assessment 2261 of the user is further based on the comparison of the supplemental physical activity data 2375A against the supplemental benchmark physical activity data 2160C.

In the example, the activity tracker 2010 further includes a pedometer 2335 configured to track a number of steps 2378A-N of the user over the time duration 2377A-N. The activity tracker processor 2010 is coupled to the pedometer 2335. Execution of the activity tracker programming 2310 by the activity tracker processor 2330 further configures the activity tracker 2010 to perform functions to monitor, via the pedometer 2335, the number of steps 2378A-N of the user over the time duration 2377A-N. Activity tracker 2010 determines, the supplemental physical activity data 2375A of the user further based on the monitored number of steps 2378A-N over the time duration 2377A-N.

As shown in FIGS. 10 and 11, the activity tracker 2010 or the computing device 110 includes an image display 2280, 2380 and an image display driver 2290, 2390 to control the image display 2280, 2380. The image display 2280, 2380 and a user input device 2291, 2391 are integrated together into a touch screen display of computing device 110 and the activity tracker 2010, respectively. However, the structure and operation of the touch screen type devices is provided by way of example; and the subject technology as described herein is not intended to be limited thereto. For purposes of this discussion, FIGS. 10 and 11 therefore provide block diagram illustrations of the example computing device 110 and the activity tracker 2010 having a touch screen display for displaying content and receiving user input as (or as part of) the user interface.

The activities that are the focus of discussions here typically involve data communications related to detecting physical activity of a user of exercise devices 300, 600, 2100, and activity tracker 2010 (e.g., wearable device) to provide a physical fitness assessment 2261. As shown in FIGS. 10 and 11, the computing device 110 and the activity tracker 2010 includes at least one digital transceiver (XCVR), shown as WWAN XCVRs 2210, 2310, for digital wireless communications via a wide area wireless mobile communication network. The computing device 110 and the activity tracker 2010 also includes additional digital or analog transceivers, such as short range XCVRs 2220, 2320 for short-range network communication, such as via NFC, VLC, DECT, ZigBee, Bluetooth™, or WiFi. For example, short range XCVRs 2220, 2320 may take the form of any available two-way wireless local area network (WLAN) transceiver of a type that is compatible with one or more standard protocols of communication implemented in wireless local area networks, such as one of the Wi-Fi standards under IEEE 802.11 and WiMAX.

To generate location coordinates for positioning of the computing device 110 and the activity tracker 2010, the computing device 110 and the activity tracker 2010 can include a global positioning system (GPS) receiver. Alternatively, or additionally the computing device 110 and the activity tracker 2010 can utilize either or both the short range XCVRs 2220, 2320 and WWAN XCVRs 2210, 2310 for generating location coordinates for positioning. For example, cellular network, WiFi, or Bluetooth™ based positioning systems can generate very accurate location coordinates, particularly when used in combination. Such location coordinates can be transmitted to the exercise device 300, 600, 2100 over one or more network connections via XCVRs 2210, 2220, 2310, 2320.

The transceivers 2210, 2220, 2310, 2320 (network communication interfaces) conform to one or more of the various digital wireless communication standards utilized by modern mobile networks. Examples of WWAN transceivers 2210, 2310 include (but are not limited to) transceivers configured to operate in accordance with Code Division Multiple Access (CDMA) and 3rd Generation Partnership Project (3GPP) network technologies including, for example and without limitation, 3GPP type 2 (or 3GPP2) and LTE, at times referred to as "4G." For example, the transceivers 2210, 2220, 2310, 2320 provide two-way wireless communication of information including digitized audio signals, still image and video signals, web page information for display as well as web related inputs, and various types of mobile message communications to/from the computing device 110 or the activity tracker 2010 for the physical fitness assessment system 1900.

Several of these types of communications through the transceivers 2210, 2220, 2310, 2320 and a network, as discussed previously, relate to protocols and procedures in support of communications to detect physical activity of a user of exercise devices and activity tracker 2010 (e.g., wearable device) to provide a physical fitness assessment 2261. Such communications, for example, may transport packet data via the short range XCVRs 2220 over the wireless connections 1925 and 1937 to and from the exercise devices as shown in FIGS. 7-9. Such communications, for example, may also transport data utilizing IP packet data transport via the WWAN XCVRs 2210, 2310 over the network (e.g., Internet) 1995 shown in FIGS. 7-9. Both WWAN XCVRs 2210, 2310 and short range XCVRs 2220, 2320 connect through radio frequency (RF) send-and-receive amplifiers (not shown) to an associated antenna (not shown).

The activity tracker 2010 and the computing device 110 further includes a microprocessor, shown as CPU 2230, 2330 sometimes referred to herein as the host controller. A processor is a circuit having elements structured and arranged to perform one or more processing functions, typically various data processing functions. Although discrete logic components could be used, the examples utilize components forming a programmable CPU. A microprocessor for example includes one or more integrated circuit (IC) chips incorporating the electronic elements to perform the functions of the CPU. The processor 2230, 2330 for example, may be based on any known or available microprocessor architecture, such as a Reduced Instruction Set Computing (RISC) using an ARM architecture, as commonly used today in mobile devices and other portable electronic devices. Of course, other processor circuitry may be used to form the CPU 2230, 2330 or processor hardware in smartphone, laptop computer, and tablet.

The microprocessor 2230, 2330 serves as a programmable host controller for the computing device 110 and the activity tracker 2010 by configuring the computing device 110 and the activity tracker 2010 to perform various operations, for example, in accordance with instructions or programming executable by processor 2230, 2330. For example, such operations may include various general operations of the computing device 110 and the activity tracker 2010, as well as operations related to the physical fitness programming 2140, activity tracker programming 2310, and communications with the exercise devices and server system 1998. Although a processor may be configured by use of hardwired logic, typical processors in mobile devices are general processing circuits configured by execution of programming.

The computing device 110 and the activity tracker 2010 includes a memory or storage device system, for storing data and programming. In the example, the memory system may include a flash memory 2240A, 2340A and a random access memory (RAM) 2240B, 2340B. The RAM 2240B, 2340B serves as short term storage for instructions and data being handled by the processor 2230, 2330 e.g. as a working data processing memory. The flash memory 2240A, 2340A typically provides longer term storage. Computing device 110 and the activity tracker 2010 can include a visible light camera 2270 and movement tracker 1918. It is noted that if computing device 110 were portable, then it may include a movement tracker 1918.

Hence, in the example of computing device 110 and activity tracker 2010, the flash memory 2240A, 2340A is used to store programming or instructions for execution by the processor 2230. Depending on the type of device, the computing device 110 and activity tracker 2010 stores and runs a mobile operating system through which specific applications, are executed. Applications, such as the physical fitness assessment programming 2140 and activity tracker programming 2310, may be a native application, a hybrid application, or a web application (e.g., a dynamic web page executed by a web browser) that runs on computing device 110 or activity tracker 2010. Examples of mobile operating systems include Google Android, Apple iOS (I-Phone or iPad devices), Windows Mobile, Amazon Fire OS, RIM BlackBerry operating system, or the like.

It will be understood that the computing device 110 is just one type of host computer in the physical fitness assessment system 1900 and that other arrangements may be utilized. For example, a server system 998, such as that shown in FIGS. 7-9 may be utilized.

FIG. 12 shows a schematic diagram of the information architecture of the physical fitness assessment system 1900 of FIGS. 7-9. As shown, the physical fitness assessment programming 2140 implemented by the computing device 110 enables sign-up for the physical fitness assessment system 1900 for a new user utilizing a social media account (e.g., Facebook or Google+) or a direct sign-in account. During sign-up, the user creates a new user profile 2155A. After sign-in by the user, the physical fitness assessment programming 2140 loads the existing user profile 2155A for the existing user.

The user profile 2155A includes profile settings 2256A-E that can include basic information such as an age 2256A, a gender 2256B, a height 2256C, a weight 2256D, a race 2256E, or another profile designator relating to a physical or other condition or characteristic of the user. The profile may include fitness preset goals or benchmark physical activity data, such as target physical activity data 2160A. Physical fitness statistics can be generated and presented to the user on the image display 2280 of the computing device 110, such as transmitted current physical activity data 1975A-D from the various exercise devices, as well as historic physical activity data 2160B. The physical fitness assessment 2261, shown as Fitness IQ Score, can track the preset goals which can vary depending on the type of exercise device.

As further shown, product-based physical fitness tracking enables current physical activity data 1975A-N to be tracked by the exercise devices, activity tracker 2010, and smart scale device 2410, and then transmitted to the computing device 110. The current physical activity data 1975A-N is then received by the computing device 110, and presented to the user on the image display 2280 of the computing device 110 as physical fitness statistics, which can include current physical activity data 1975A-D and historical physical activity data 2160B. Alternatively, the computing device 110 compares the current physical activity data 1975A-N of the user against benchmark physical activity data correlated with the exercise device, activity tracker 2010, or smart scale device; and based on the comparison, the computing device 110 determines the physical fitness assessment 2261 of the user.

For the activity tracker 2010, the current physical activity data 2470 includes number of steps 2378A-N, distance traveled 2405A-N, calories burned 2406A-N, time duration 2377A-N, and heart rate 2376A-N, for example, where A-N correspond to various segments of divided physical activity (e.g., as divided by physical activity bursts or time). For the exercise device 300 or 600, the current physical activity data 1975A includes the number of sets 1969A-N, the number of repetitions 1970A-N, the time duration 1974A-N, and amount of weight 1973A-N.

For the smart scale device 2410, the current physical activity data 2475 includes various physical attributes. For example, the current physical activity data 2475 optionally includes body weight 2411, body fat 2412, body water 2413, muscle mass 2414, body mass index (BMI) 2415, basal metabolic rate 2416 (BMR—e.g., in kilocalories), bone mass 2416, and/or visceral fat 2418.

FIG. 13 is a flow diagram that shows an example of a method of providing a physical fitness assessment 2261 to a user that can be implemented in the physical fitness programming 2140 of the computing device 110. Beginning in block 2500, the method includes receiving tracked current physical activity data 1975A-N of the user, from an exercise device, via a host computer communication interface 2220. Proceeding to block 2510, the method further includes receiving, via a host computer user input device 2291, a physical fitness assessment selection 2259. Continuing to block 2520, the method further includes obtaining a physical fitness assessment 2261 of the user based on a determined relationship of the current physical activity data 1975A-N relative to benchmark physical activity data 2160A-N correlated with the exercise devices as indicated by the received physical fitness assessment selection 2259.

Finishing now in block 2530, the method further includes presenting the physical fitness assessment 2261 to the user via a host computer user interface 2280. In some examples, a subset or all of the blocks may be implemented in the exercise device programming 1945, physical fitness assessment server programming 2150, or the activity tracker programming 2315.

Any of the functionality described herein for the exercise devices, activity tracker 2010, server system 1998, and smart scale device 2410 can be embodied in one more applications or firmware as described previously and stored in a machine-readable medium. According to some embodiments, "function," "functions," "application," "applications," "instruction," "instructions," or "programming" are program(s) that execute functions defined in the programs. Various programming languages can be employed to create one or more of the applications, structured in a variety of manners, such as object-oriented programming languages (e.g., Objective-C, Java, or C++) or procedural programming languages (e.g., C or assembly language). In a specific example, a third party application (e.g., an application developed using the ANDROID™ or IOS™ software development kit (SDK) by an entity other than the vendor of the particular platform) may be mobile software running on a mobile operating system such as IOS™, ANDROID™, WINDOWS® Phone, or another mobile operating systems. In this example, the third party application can invoke API calls provided by the operating system to facilitate functionality described herein.

Hence, a machine-readable medium may take many forms of tangible storage medium. Non-volatile storage media include, for example, optical or magnetic disks, such as any of the storage devices in any computer(s) or the like, such as may be used to implement the exercise devices, activity tracker 2010, computing device 110, server system 1998, and smart scale device 2410 shown in the drawings. Volatile storage media include dynamic memory, such as main memory of such a computer platform. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

Further details of physical fitness assessment system are disclosed in U.S. patent application Ser. No. 16/887,125 to Owusu, which is incorporated by reference herein in its entirety and for all purposes.

What is claimed is:

1. A physical fitness system comprising:

a stand assembly including a stand, a computing device mounted on the stand, and at least one integrated docking station for receiving an exercise device, the computing device having (i) a user input for inputting instructions to the computing device relating to the exercise device, (ii) a system network communication interface for communication over a network, and (iii) a system computer processor coupled to the user input and the system network communication interface; and at least one exercise device that is configured to be releasably mounted to the docking station, said exercise device including (i) a driver for selectively changing either a resistance applied to the exercise device or a weight carried by the exercise device, (ii) an exercise device network communication interface for communication over the network, (iii) an exercise device processor coupled to the exercise device network communication interface and the driver; and (iv) a movement tracker connected to the exercise device processor and configured to track movement of the exercise device, wherein, upon receiving instructions from the user input, the system computer processor is configured to transmit instructions over the network from the system network communication interface to the exercise device network communication interface, and upon receiving the instructions, the exercise device processor is configured to activate the driver to change either the resistance applied to the exercise device or the weight carried by the exercise device, and wherein the system computer processor is configured to:

detect removal and use of the at least one exercise device from the docking station based on the movement tracked by the movement tracker; and present, via an image display of the computing device, real-time exercise data for the at least one exercise device based on the movement tracked by the movement tracker.

2. The physical fitness system of claim 1, wherein the docking station comprises an electrical terminal that is configured to deliver power to a mating electrical terminal on the exercise device for powering the exercise device.

3. The physical fitness system of claim 1, wherein the stand comprises a plurality of integrated docking stations that are each configured for receiving a respective exercise device.

4. The physical fitness system of claim 1, wherein the exercise device comprises a kettlebell or a dumbbell.

5. The physical fitness system of claim 4, wherein the exercise device comprises a plurality of weights and a shaft that is configured to be moved by the driver to selectively engage one or more weights of the plurality of weights thereby changing the weight carried by the exercise device.

6. The physical fitness system of claim 1, wherein the at least one exercise device further comprises:

an exercise device memory connected to the exercise device processor, and exercise device programming stored in the exercise device memory, wherein execution of the exercise device programming by the exercise device processor configures the at least one exercise device to perform functions to:

determine a current physical activity data of the user based on, at least, the tracked movement of the exercise device by the user; and transmit over the network, via the exercise device network communication interface, the current physical activity data of the user.

7. The physical fitness system of claim 6, wherein the computing device further comprises:

a system computer memory connected to the system computer processor, and system computer programming in the system computer memory, wherein execution of the system computer programming by the system computer processor configures the computing device to perform functions, including functions to:

receive over the network from the exercise device, via the system network communication interface, the current physical activity data of the user; and present, via the image display of the computing device, a physical fitness assessment image based upon the current physical activity data of the user.

8. The physical fitness system of claim 1, wherein the stand comprises a base for contacting a floor surface, and a vertically extending frame member extending upwards from the base, and the computing device further comprises an image display that is adjustably mounted to the vertically extending frame member for facing a user, and wherein the at least one docking station is either formed on or is connected to the stand.

9. The physical fitness system of claim 1, wherein the at least one exercise device comprises a first exercise device and a second exercise device, each exercise device being configured to be releasably mounted to separate docking stations on the stand assembly.

10. The physical fitness system of claim 9, wherein the first exercise device is a kettlebell and the second exercise device is a dumbbell.

11. A method for operating a physical fitness system comprising (a) a stand assembly having a computing device and at least one integrated docking station for receiving an exercise device, the computing device including (i) a user input for inputting instructions to the computing device relating to the exercise device, (ii) a system network communication interface for communication over a network, and (iii) a system computer processor coupled to the user input and the system network communication interface, and (b) at least one exercise device that is configured to be releasably mounted to the docking station, said exercise device including (i) a driver for selectively changing either a resistance applied to the exercise device or weight carried by the exercise device, (ii) an exercise device network communication interface for communication over the network, (iii) an exercise device processor coupled to the exercise device network communication interface and the driver, and (iv) a movement tracker connected to the exercise device processor and configured to track movement of the exercise device, said method comprising:

receiving instructions via the user input of the computing device for changing either a resistance applied to the exercise device or the weight carried by the exercise device;

transmitting instructions over the network from the system network communication interface to the exercise device network communication interface;

activating the driver to change either the resistance applied to the exercise device or the weight carried by the exercise device;

detecting removal and use of the exercise device from the docking station based on the movement tracked by the movement tracker; and presenting, via an image display of the computing device, real-time exercise data for the exercise device based on the movement tracked by the movement tracker.

12. The method of claim 11 further comprising deliver powering from the stand assembly to the at least one exercising device stowed at the docking station for powering the exercise device.

13. The method of claim 11 further comprising receiving instructions via the user input of the computing device for changing either a resistance applied to a second exercise device or the weight carried by the second exercise device;

transmitting instructions over the network from the system network communication interface to the exercise device network communication interface for the second exercise device; and activating the driver to change either the resistance applied to the second exercise device or the weight carried by the second exercise device.

14. The method of claim 11, wherein the exercise device comprises a kettlebell or a dumbbell.

15. The method of claim 14, wherein the exercise device comprises a plurality of weights and a shaft that is configured to be moved by the driver to selectively engage one or more weights of the plurality of weights thereby changing the weight carried by the exercise device.

16. The method of claim 11, wherein the at least one exercise device further comprises:

an exercise device memory connected to the exercise device processor, and an exercise device programming stored in the exercise device memory, wherein the method further comprises executing the exercise device programming by the exercise device processor so that the at least one exercise device performs functions to:

determine a current physical activity data of the user based on, at least, the tracked movement of the exercise device by the user; and transmit over the network, via the exercise device network communication interface, the current physical activity data of the user.

17. The method of claim 16, wherein the computing device further comprises:

a system computer memory connected to the system computer processor, and system computer programming in the system computer memory, wherein the method further comprises executing the system computer programming by the system computer processor to configure the computing device to perform functions, including functions to:

receive over the network, via the system network communication interface, from the exercise device the current physical activity data of the user; and present, via the image display of the computing device, a physical fitness assessment image based upon the current physical activity data of the user.

18. A method for using a physical fitness system comprising a stand assembly having a computing device and at least one integrated docking station for receiving an exercise device, the computing device including (i) a user input for inputting instructions to the computing device relating to the exercise device, (ii) a system network communication interface for communication over a network, and (iii) a system computer processor coupled to the user input and the system network communication interface, and (b) at least one exercise device that is configured to be releasably mounted to the docking station on the stand, said exercise device including (i) a driver for selectively changing either a resistance applied to the exercise device or weight carried by the exercise device, (ii) an exercise device network communication interface for communication over the network, (iii) an exercise device processor coupled to the exercise device network communication interface and the driver, and (iv) a movement tracker connected to the exercise device processor and configured to track movement of the exercise device, said method comprising:

entering instructions via the user input of the computing device for changing either a resistance applied to the exercise device or the weight carried by the exercise device, which causes the instructions to be transmitted over the network from the system network communication interface to the exercise device network communication interface, which causes the driver to change either the resistance applied to the exercise device or the weight carried by the exercise device;

removing the exercise device from the stand for use; the removal and use of the exercise device from the stand being detected based on the movement tracked by the movement tracker; and viewing, via an image display of the computing device, real-time exercise data for the exercise device based on the movement tracked by the movement tracker.

19. The method of claim 18, wherein the exercise device comprises a kettlebell or a dumbbell.

20. The method of claim 18, wherein the exercise device comprises a plurality of weights and a shaft that is configured to be moved by the driver to selectively engage one or more weights of the plurality of weights thereby changing the weight carried by the exercise device.

21. The method of claim 18 further comprising entering instructions via the user input of the computing device for changing either a resistance applied to a second exercise device or the weight carried by the second exercise device, which causes the instructions to be transmitted over the network from the system network communication interface to the exercise device network communication interface of the second exercise device, which causes the driver to change either the resistance applied to the second exercise device or the weight carried by the second exercise device; and removing the second exercise device from the stand for use.

* * * * *